US012123679B1

(12) United States Patent
Kirk et al.

(10) Patent No.: US 12,123,679 B1
(45) Date of Patent: Oct. 22, 2024

(54) ADJUSTABLE APPARATUS HOLDER

(71) Applicant: U.S. Government as Represented by the Secretary of the Army, Natick, MA (US)

(72) Inventors: John Kirk, Ashland, MA (US); Richard D Landry, Worcester, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 333 days.

(21) Appl. No.: 17/870,966

(22) Filed: Jul. 22, 2022

Related U.S. Application Data

(60) Continuation-in-part of application No. 17/698,031, filed on Mar. 18, 2022, now Pat. No. 11,747,108, and a division of application No. 16/903,547, filed on Jun. 17, 2020, now Pat. No. 11,313,644, and a continuation of application No. 16/219,987, filed on Dec. 14, 2018, now abandoned.

(51) Int. Cl.

| | |
|---|---|
| ***F41C 33/02*** | (2006.01) |
| ***A45F 5/02*** | (2006.01) |
| ***F41C 33/04*** | (2006.01) |
| *A45F 5/00* | (2006.01) |

(52) U.S. Cl.
CPC ..... *F41C 33/0263* (2013.01); *A45F 5/021* (2013.01); *F41C 33/045* (2013.01); *A45F 2005/002* (2013.01); *A45F 2005/025* (2013.01)

(58) Field of Classification Search
CPC ..... F41C 33/045; F41C 33/0263; F41C 33/0227; F41C 33/041; F41C 33/0209; A45F 2200/0591; A45F 2005/025; A45F 2005/026; Y10T 403/60; Y10T 403/602; Y10T 403/608; F16M 3/02; F16M 13/022; G06F 1/187
USPC ..... 224/904, 930, 912, 192–193, 198, 238, 224/243; 248/220.22, 220.21, 222.11, 248/221.12, 222.13, 222.5; 403/348; 52/434; 383/61.2, 63
See application file for complete search history.

(56) References Cited

U.S. PATENT DOCUMENTS

| | | | | |
|---|---|---|---|---|
| 4,022,361 A * | 5/1977 | Devlin | F41C 33/041 | 224/192 |
| 5,941,434 A * | 8/1999 | Green | A45F 5/02 | 224/195 |
| 8,517,234 B2 * | 8/2013 | Kincaid | F41C 33/045 | 224/198 |

(Continued)

*Primary Examiner* — Adam J Waggenspack
(74) *Attorney, Agent, or Firm* — Timothy M. Barlow

(57) ABSTRACT

Apparatuses are disclosed herein for holding and securing an item. In one embodiment the item holder includes at least one layer of material between two outer layers of material. The two outer layers are made of a different material than the material of the at least one layer of material. Portions of the two outer layers and the at least one layer are secured together to form an opened ended receptacle for receiving an item. A set of hook/loop fasteners are secured to the exterior of the receptacle. The item holder also includes a material loop adapted to receive the receptacle. The material loop includes an interior surface that includes a second set of hook/loop fasters adapted to contact the first set of hook/loop fasteners. Although not required, an insertion tool may be used for insertion of receptacle into the material loop.

16 Claims, 28 Drawing Sheets

(56) References Cited

U.S. PATENT DOCUMENTS

| | | | | |
|---|---|---|---|---|
| 10,107,588 | B2 * | 10/2018 | Rogers | F41C 33/046 |
| 10,856,642 | B1 * | 12/2020 | Spell | A45F 5/02 |
| 10,962,326 | B2 * | 3/2021 | Mills | F41C 33/048 |
| 2008/0302839 | A1 * | 12/2008 | Murdoch | A45F 3/04 224/153 |

* cited by examiner

ADJUSTABLE APPARATUS HOLDER

CROSS-REFERENCE TO RELATED APPLICATIONS

This application is a continuation-in-part application that claims benefit under 35 U.S.C. § 119(e) of U.S. Provisional Patent Application No. 62/599,966, filed on Dec. 18, 2017 and Non-Provisional application Ser. No. 16/219,987 filed on Dec. 14, 2018 and are both incorporated herein by reference in its entirety.

STATEMENT OF GOVERNMENT INTEREST

The material described herein may be manufactured and used by or for the U.S. Government for governmental purposes without the payment of any royalties thereon or therefor.

FIELD OF THE DISCLOSURE

The present disclosure relates generally to apparatus, systems and methods for adjustably holding a device.

BACKGROUND

There are many apparatus holders on the market made of textiles, laminates, leather and plastics. In addition, some apparatus holders allow adjustable orientation with respect to a user. Although some of these apparatus holders are adjustable their design can often make these holders susceptible to environmental contaminates.

Some of the apparatus holders include a locking mechanism(s) to prevent unwanted extraction of the apparatus from the housing. However, these locking mechanisms are also susceptible to environmental contaminates. In addition, the apparatus holders and the ability to reorient them with respect to a user is often non-ambidextrous.

BRIEF DESCRIPTION OF THE FIGURES

The accompanying figures, for which like reference numerals refer to identical or functionally similar elements throughout the separate views, together with the detailed description below, are incorporated in and form part of the specification. The figures serve to illustrate embodiments of concepts included in the claims and to show various features and advantages of those embodiments.

Figure 1A:
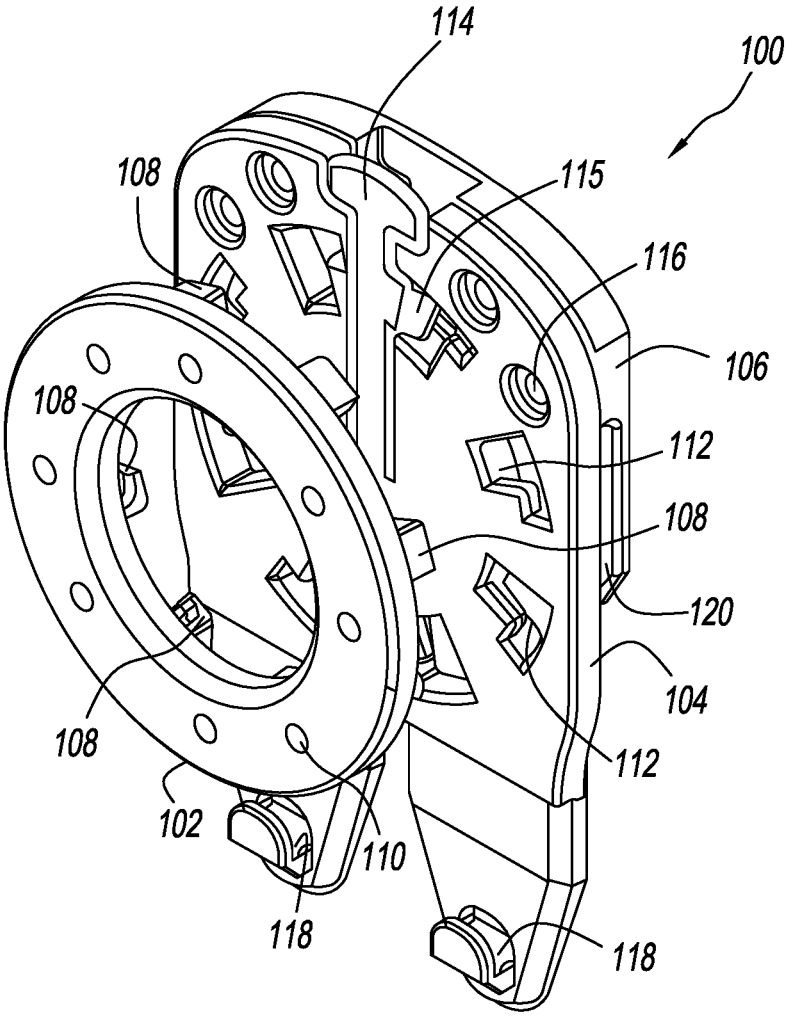
FIG. 1A shows a perspective view of an embodiment of a lock mount, in accordance with embodiments described herein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The system, apparatus and method components have been represented, where appropriate, by conventional symbols in the drawings, showing only those specific details that are pertinent to understanding the embodiments of the present teachings so as not to obscure the disclosure with details that will be readily apparent to those of ordinary skill in the art having the benefit of the description herein.

SUMMARY

Generally speaking, pursuant to various embodiments described herein, the present disclosure provides apparatuses and methods for adjustably holding a device. For example, in one embodiment an item holder includes at least one layer of material between two outer layers of material. The two outer layers are made of a different material than the material of the at least one layer of material. Portions of the two outer layers and the at least one layer are secured together to form an opened ended receptacle for receiving an item. A set of hook/loop fasteners are secured to the exterior of the receptacle. The item holder also includes a material loop adapted to receive the receptacle. The material loop includes an interior surface that includes a second set of hook/loop fasters adapted to contact the first set of hook/loop fasteners. Although not required, an insertion tool may be used for insertion of receptacle into the material loop. In various embodiments, the insertion tool is a unitary piece of material. In other embodiments, the insertion tool is multiple pieces that when used together are the insertion tool.

DETAILED DESCRIPTION

The following detailed description references the accompanying figures in describing embodiments consistent with this disclosure. The example embodiments are provided for illustrative purposes and are not exhaustive. Additional embodiments not explicitly illustrated or described are possible. Further, modifications can be made to presented embodiments within the scope of the present teachings. The detailed description is not meant to limit this disclosure. Rather, the scope of the present disclosure is defined only in accordance with the presented claims and equivalents thereof.

Throughout this specification reference to "guns" is to include reference to other related products. Although a holster for guns is described, it will be realized that the material presented herein could be used in relation to many other products which are used in related fields such as, for example, holsters or containers for batons, handcuffs, ammunition rounds, and the like. As such, a "holster" as used herein is defined as a receptacle specifically configured for holding an item (e.g., any tool having a sole purpose as a weapon that can be mounted or worn), and in some embodiments, the receptacle includes additional features that further secure the item within the receptacle.

The material described herein includes apparatuses that may be ambidextrous. Although not required the material described herein can be used with MOLLE webbing. This document incorporates by reference all of the material in U.S. Pat. No. 5,724,707 issued Mar. 10, 1998.

Figure 1B:
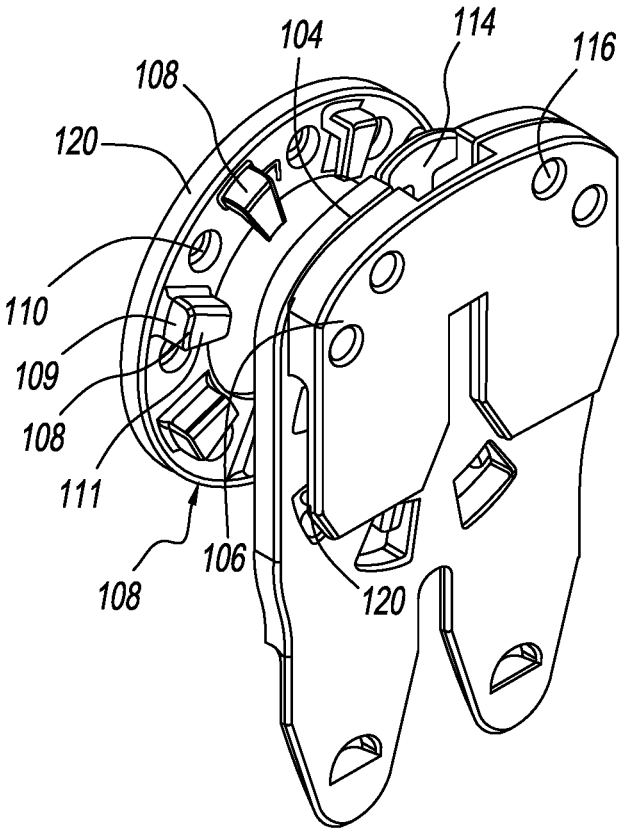
FIG. 1B is another perspective view of the lock mount depicted in FIG. 1A.

FIG. 1A shows a perspective view of an embodiment of an adjustable mount 100, in accordance with embodiments described herein. The adjustable mount 100 includes a male interlocking ring 102, a female interlocking plate 104 and a rear mounting plate 106. FIG. 1B is another perspective view of the adjustable mount depicted in FIG. 1A.

The male interlocking ring 102 includes a plurality of male interlock members 108. Each of the male interlock members 108 has a geometry that allows insertion into a female interlocking member 112. For example, each of the male interlock members 108 includes an extension 109 that has a proximal end connected to the male interlock ring 102. Extension 109 extends away from the male interlocking ring 102 to a distal end. Attached to the distal end of extension 109 is extension 111. Extension 111 extends laterally away from the distal end of extension 109. Extension 109 and extension 111 form an "L-shape."

For illustrative purposes only, the number of male interlock members 108 is depicted as eight. However, in other embodiments, the number of male interlock members 108 can be fewer than eight or greater than eight. The male interlocking ring 102 also includes a plurality of mounting holes 110.

The female interlocking plate 104 includes a plurality of female interlocking members 112, a release lever 114, a plurality of mounting holes 116, and at least one strap hook 118. For illustrative purposes only, the number of female interlock members 112 is depicted as eight. The female interlock members 112 have a shape that receives extension 109 and extension 111. The hole shape of each of the female interlock members 112 includes a first portion and a second portion where the first portion is larger than a second portion of the hole.

In various embodiments, the number of female interlock members 112 can be fewer than eight or greater than eight. In FIGS. 1A, 1*i*, 2, and 3 the number of female interlock member 112 correspond to the number of male interlock members 108. However, in various embodiments the number of female interlock members 112 is greater than the number of male interlock members 108.

The release lever 114 includes a lever stop 115. The lever-stop 115 extends laterally away from the release lever 114, towards and partially into the hole of one of the female interlock members 112.

The release lever 114 is a unitary part of the female interlocking plate 104. For example, when the female interlocking plate 104 is formed (e.g., via injection molding, stamped, additive manufactured (i.e., "3D printed"), or computer numerical control ("CNC")) the release lever 114 is also formed.

A user can position the device to a desired orientation by aligning the male interlock members 108 with the female interlock members 112. For example, when a holster is secured to the male interlocking ring 102, the holster may be oriented to a preferred drawing angle and aligned with female interlocking plate 104 via the male interlocking ring 102. In another example, the holster may be oriented for comfort when a user is in a seated position.

To secure the male interlocking ring 102 to the female interlocking plate 104, pressure is applied to the release lever 114. In one embodiment, a user deforms (i.e., bends) the release lever 114 by applying pressure causing the release lever 114 to move away from the male interlocking ring 102. The lever-stop 115 moves in unison with release lever 114. Pressing the release lever 114 moves the lever-stop 115 out of the way of a male interlock member 108. The male interlocking ring 102 is oriented appropriately and each male interlock member 108 is aligned with a female interlock member 112. The male interlock members 108 are inserted into the first portions of the female interlock members 104 and rotated (e.g., clockwise) towards the second portions in the female interlock members 104 that are smaller than the first portions.

After the male interlock members 108 are inserted into female interlock members 112, the user stops applying pressure to the release lever 114. When no pressure is applied to the release lever 114, a bias associated with the release lever 114 causes the release lever 114 to move back towards its resting position (i.e., no force is applied to deform the release lever 114). When the release lever 114 and lever-stop 115 are in the resting position, the lever-stop obstructs one of the male interlock members 108 from being rotated and extracted from the corresponding female interlock member 112. Because the male interlock members 108 move in unison, impeding the movement of one of the male interlock members 108 also impedes movement of the other male interlock members 108.

The amount of pressure used to deform the release lever 114 is dependent upon multiple factors such, as for example, the material used to make the female interlocking plate 104 and release lever 114; and the geometry/dimensions of the release lever 114.

To disengage/separate the male interlocking ring 102 from the female interlocking plate 104, the user depresses the release lever 114. The male interlocking ring 102 is rotated in a direction opposite to the direction used to interlock the male interlocking ring 102 with the female interlocking plate 104. After rotation, the male interlocking ring 102 is separated from the female interlocking plate 104 and the release lever 114 is released.

In one embodiment the female interlocking plate 104 includes the mounting holes 116. Screws or bolts (not shown) can be used to secure the female interlocking plate 104 to the rear mounting plate 106. However, in various embodiments the female interlocking plate 104 does not include the mounting holes 116 and an adhesive is used to secure the female interlocking plate 104 to the rear mounting plate 106. In yet other embodiments, the female interlocking plate 104 and rear mounting plate 106 are constructed as one unitary piece. For example, the female interlocking plate 104 and rear mounting plate 106 are both formed together as one piece via injection molding, stamping, 3-D printing, or CNC.

The rear mounting plate 106 also includes hook portions 120 adapted to hook a strap (not shown). Hooking onto the strap supports components attached to the rear mounting plate 106. For example, when the rear mounting plate 106 is secured to a strap, the strap supports the rear mounting plate 106 and the female interlocking plate 104; the male interlocking ring 102; and an apparatus holder (e.g., any sleeve, holster, sheath, and/or apparatuses) attached to the male interlocking ring 102. The rear mounting plate 106 in conjunction with the strap hooks 118 secures the adjustable mount 100 in place.

For illustrative purposes only, the number of strap hooks 118 is depicted as two. However, various embodiments can include a different number of strap hooks 118. In various embodiments, the strap hooks 118 and rear mounting plate 106 are used to secure the adjustable mount 100 to a MOLLE system.

When formed as separate components, the male interlocking ring 102, the female interlocking plate 104 and rear mounting plate 106 can be made of separate materials and/or processes.

Figure 2:
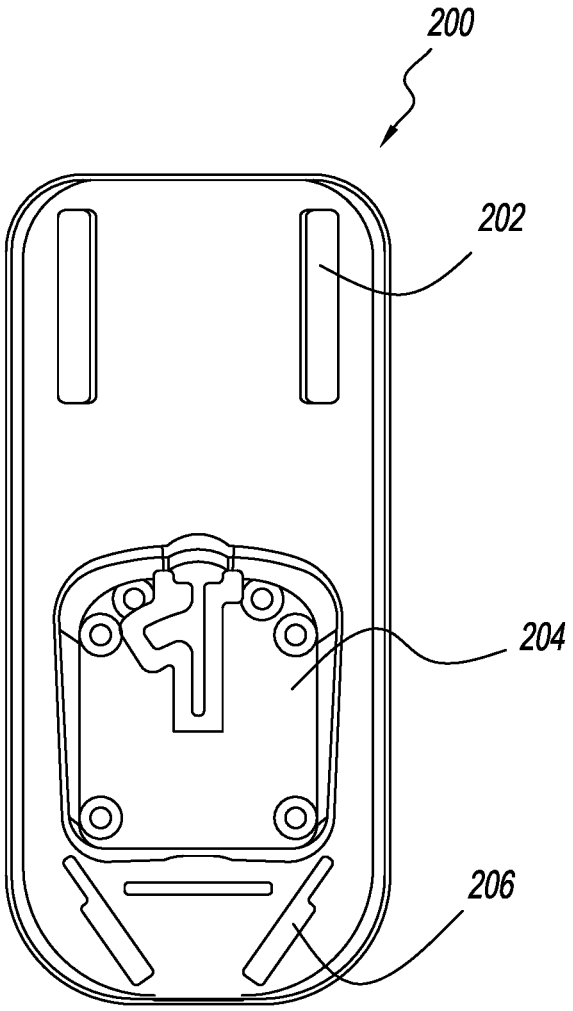
FIG. 2 is a perspective view of an embodiment of a lock mount, in accordance with embodiments described herein.

FIG. 2 is a perspective view of another embodiment of a lock mount 200, in accordance with embodiments described herein. The lock mount 200 is a belt mount. The lock mount 200 includes slots 202 and slots 206. The slots 202 and slots 206 are adapted to receive belts/straps (not shown) and secure the lock mount 200 to a user's waist.

The lock mount 200 includes female interlocking plate 204. The female interlocking plate 204 functions similarly to the female interlocking plate 104 described above. As such, the female interlocking plate 204 is not described in further detail. In various embodiments, the female interlocking plate 204 is formed as one unitary piece with the lock mount 200. In other embodiments, the female interlocking plate 204 and lock mount 200 are two separate pieces that are secured together (e.g., by screws or an adhesive).

Figure 3:
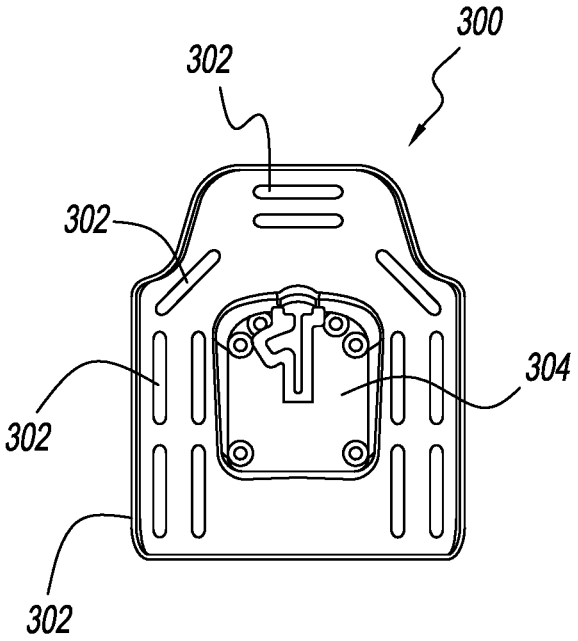
FIG. 3 is a perspective view of yet another embodiment of a lock mount, in accordance with embodiments described herein.

FIG. 3 is a perspective view of yet another embodiment of a lock mount 300, in accordance with embodiments described herein. The lock mount 300 is a leg mount. The lock mount 300 includes slots 302. The slots 302 are adapted to receive belts/straps (not shown) and secure the lock mount 300 to a user's leg. The lock mount 300 is worn lower on the user than the lock mount 200 secured to the waist.

The lock mount 300 includes female interlocking plate 304. The female interlocking plate 304 functions similarly to the female interlocking plate 104 described above. As such, the female interlocking plate 304 is not described in further detail. In various embodiments, the female interlocking plate 304 is formed as one unitary piece with the lock mount 300. In other embodiments, the female interlocking plate 304 and lock mount 300 are two separate pieces that are secured together (e.g., by screws or an adhesive).

In various embodiments, the male interlocking ring 102 is secured to the lock mount 100, 200, 300; and the female interlocking plate 104 is secured to a holster, sheath or sleeve. In various other embodiments, either the male interlocking ring 102 or the female interlocking plate 104 is secured to a vehicle, furniture, fixture, or building fixture.

Figure 4A:
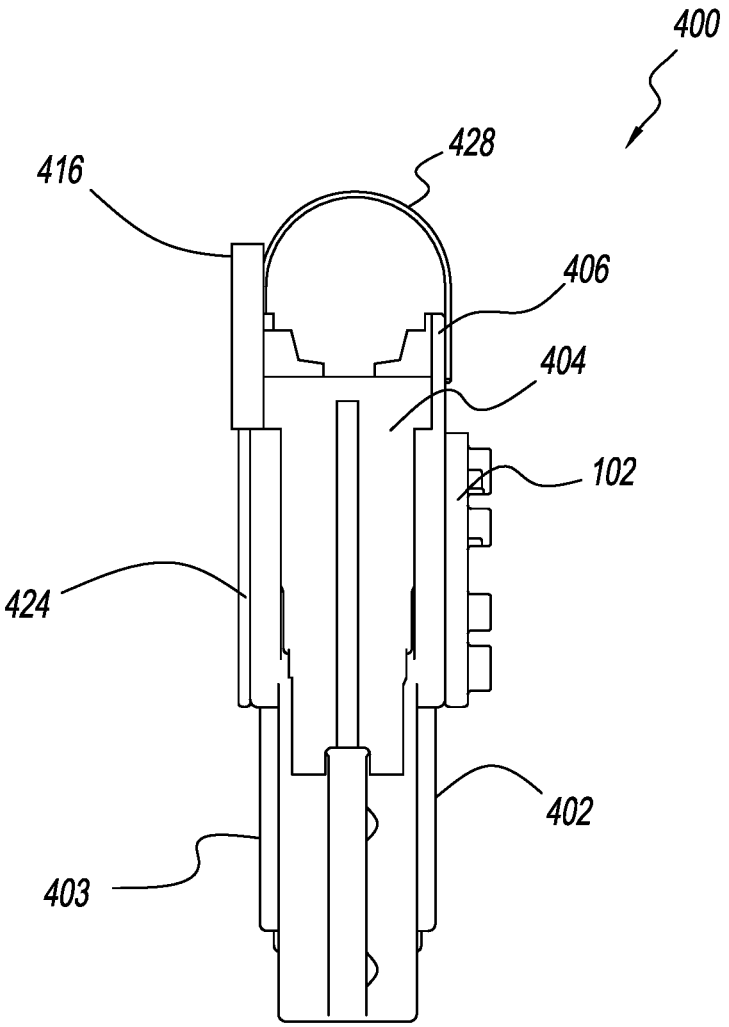
FIG. 4A depicts a top view of a holster sleeve with a top portion removed, in accordance with embodiments described herein

Various apparatus holders may be used with the lock mounts described herein. For example, FIG. 4A depicts a perspective view of a holster sleeve 400 with a portion removed so that a flexible tongue 404 is visible, in accordance with embodiments described herein. The holster sleeve 400 includes a left holster sleeve side 402 and a right holster sleeve side 403, the flexible tongue 404, a release 406 on one end of the flexible tongue 404, and a guard plate 424.

The left holster sleeve side 402 and right holster sleeve side 403 may be made simultaneously as one unitary piece (e.g., through injection molding) or made separately and subsequently secured together (e.g., via bonding, bolting or screwing these two components together).

Although not required, the release 406 is adapted to receive a thumb brake 416. To allow ambidextrous use of the release 406, the release 406 includes holes on both sides for receipt of screws (not shown) to secure the thumb brake 416 to the release 406.

In FIG. 4A, the thumb brake 416 is secured to the right side of the release 406 and flexible tongue 404; the guard plate 424 is secured to the right holster sleeve side 403; and the male interlocking ring 102 is secured to the left holder sleeve side 402. In this configuration, the holster sleeve 400 is worn on the right side of the user. However, by interchanging the guard plate 424 and the male interlocking ring 102; and moving the thumb brake 416 to the left side of the release 406 the holster sleeve 400 is configured to be worn on the left side of the user.

Although FIG. 4A depicts the holster sleeve 400 as including the male interlocking ring 102 other embodiments include the female interlocking plate 104 secured to the holster sleeve 400. Yet other embodiments include the holster sleeve 400 coupled in some manner to a user or object without either the male interlocking ring 102 or female interlocking plate 104.

FIG. 4A also depicts an optional elastomeric band 428. After insertion of the handgun into the holster sleeve 400, the elastomeric band 428 is stretched over the butt of the handgun (not shown). The elastomeric band 428 provides additional resistance from unwanted extraction of the handgun from the holster sleeve 400.

The left holster sleeve side 402 and the right holster sleeve side 403 each includes on their interior a tongue slot 436 that is adapted to receive the flexible tongue 404. When the left holster sleeve side 402, right holster sleeve side 403, flexible tongue 404 are together they form a cavity that is shaped to receive the handgun (not shown in the FIGS.). When the left holster sleeve side 402 and the right holster sleeve side 403 are together, the tongue slot 436 on each of them are aligned to hold a portion of the flexible tongue 404 in a fixed position with respect to the holster sleeve 400. Wedge 412 (shown in FIGS. 5A, 5B and 5C) is one of multiple protrusions with successively smaller locating wedges which match cutouts in the flexible tongue 404. These wedges 412 locate the flexible tongue 404 in relation to the sleeve halves 402 and 403 and lock the flexible tongue 404 from being pulled out from the holster sleeve 400 once installed. This feature tapers down from a tapered portion 504 of the flexible tongue 404 in such a manner to eliminate stress concentrations at the point of flexure.

The left holster sleeve side 402 and right holster sleeve side 403 can be molded to accommodate any accessories mounted to the handgun. For example, the handgun may be either a XM-17 or XM-18 (both of which are registered trademarks of SIG SAUER, Inc. headquartered in Newington, New Hampshire).

Figure 4B:
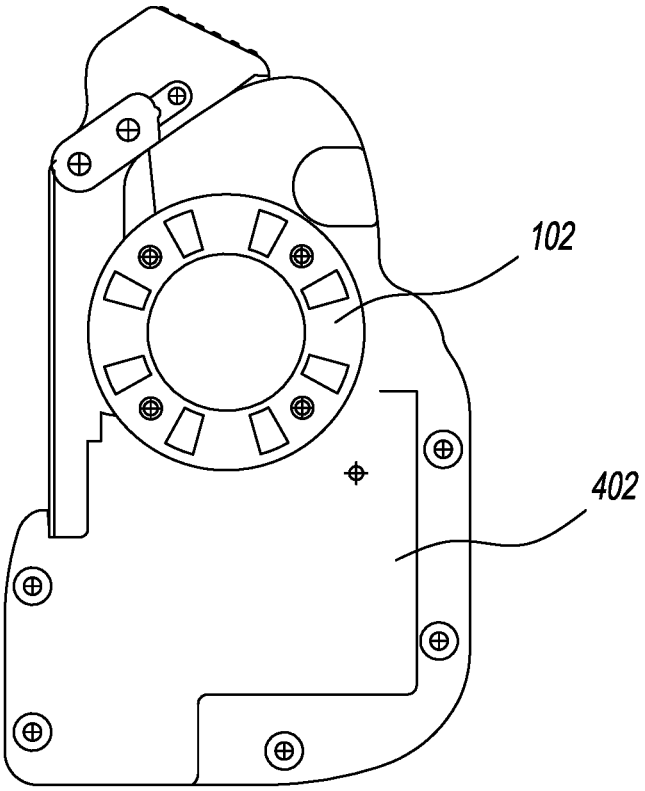
FIG. 4B depicts a side view of a portion of the holster sleeve depicted in FIG. 4A, in accordance with embodiments described herein.

FIG. 4B depicts a side view of the holster sleeve 400 depicted in FIG. 4A, in accordance with embodiments described herein.

Figure 4C:
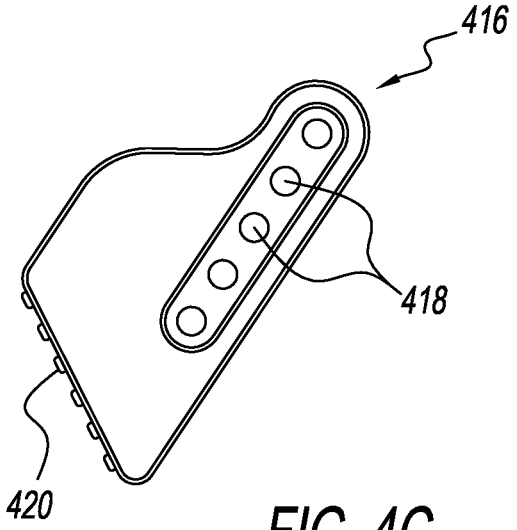
FIG. 4C depicts a perspective view of a thumb brake, in accordance with embodiments described herein.

FIG. 4C depicts a perspective view of a thumb brake 416, in accordance with embodiments described herein. The thumb brake 416 includes a plurality of threaded through-holes 418 that are used to receive screws for attachment of the thumb brake 416 to the release 406.

To allow a user ambidextrous use of the flexible tongue 404, the thumb brake 416 may be flipped over for mounting to either side of the release 406 and height adjustment for a user's thumb. In various embodiments, thumb brake 416 includes some type of texturing 420 that is an uneven surface to reduce the likelihood of a user's thumb slipping off the thumb brake 416.

Figure 4D:
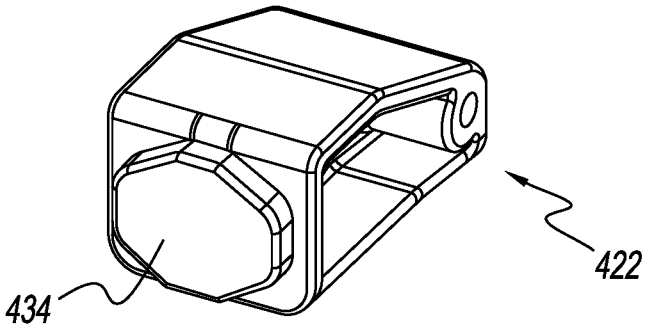
FIG. 4D depicts a perspective view of a spacer, in accordance with embodiments described herein.

FIG. 4D depicts a perspective view of an embodiment of a spacer 422, in accordance with embodiments described herein. When the holster sleeve 400 has been molded to accommodate the handgun that molding can also allow for accessories (not shown) mounted to the handgun. Examples of accessories that can be mounted to the handgun include but are not limited to a weapon light and/or handgun laser. When the handgun is inserted in the holster sleeve 400, the handgun should fit into the holster sleeve 400 so that a portion of the flexible tongue 404 prevents extraction of the handgun.

When the interior of the holster sleeve 400 includes space for an accessory and the handgun does not include the accessory, the spacer 422 is placed inside the holster sleeve 400. The spacer 422 fills a void that would otherwise be occupied by the accessory installed on the handgun. The spacer 422 also includes a nib 426 which is a protrusion that allows a user to hold onto and extract the spacer 426 from the holster sleeve 400.

Figure 4E:
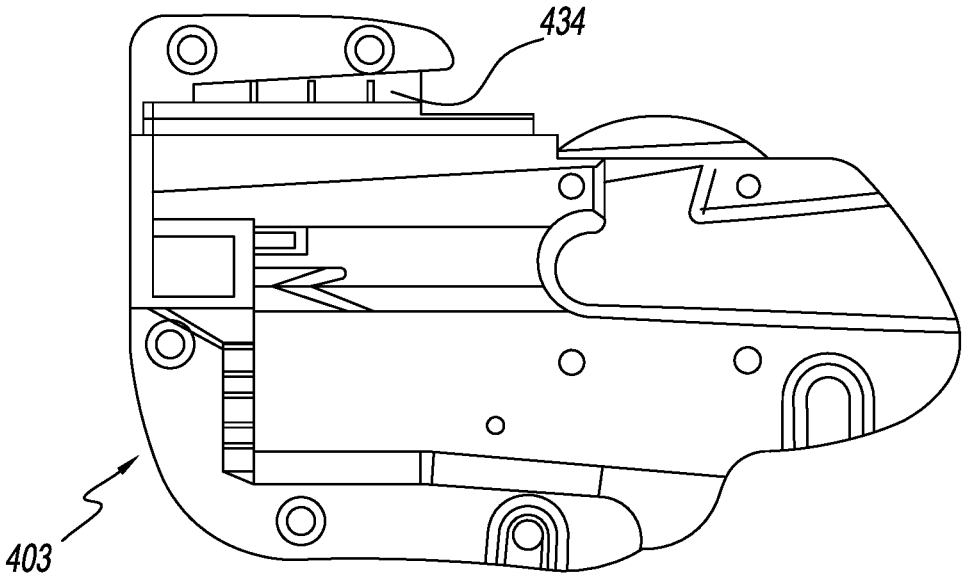
FIG. 4E depicts a cross-sectional view of the holster sleeve shown in FIG. 4A, in accordance with embodiments described herein.

FIG. 4E depicts a cross-sectional view of the holster sleeve shown in FIG. 4A, in accordance with embodiments described herein. In FIG. 4A, an interior of the right holster sleeve side 403 is shown so that the tongue slot 436 is visible.

Figure 5A:
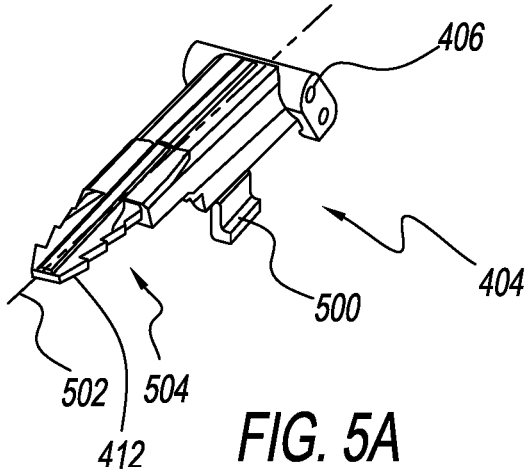
FIG. 5A depicts a perspective view of a flexible tongue, in accordance with embodiments described herein.

FIG. 5A depicts a perspective view of the flexible tongue 404, in accordance with embodiments described herein. The flexible tongue 404 includes a proximal end and a distal end. The release 406 is located on the proximal end of the flexible tongue 404. The flexible tongue 404 includes a longitudinal axis 502.

Also, on opposing peripheral edges of the flexible tongue 404 are slide catches 500. The slide catches 500 extend downward (i.e., away from the flexible tongue 404). The slide catches 500 align with an edge of a gun slide and ejection port of a handgun. The slide catches 500 prevent movement of the gun slide out of the holster sleeve 400. As a result, the slide catches 500 also prevent the handgun from being extracted out of the holster sleeve 400.

Moving away from the release 406 and after the slide catches 500 is a tapered portion 504. The tapered portion 504 has smaller dimensions than the proximal end of the flexible tongue 404. Because the tapered portion 504 has smaller dimensions, the tapered portion 504 has more flexibility than the proximal end. The tapered portion 504 also resides in the tongue slot 436.

Figure 5B:
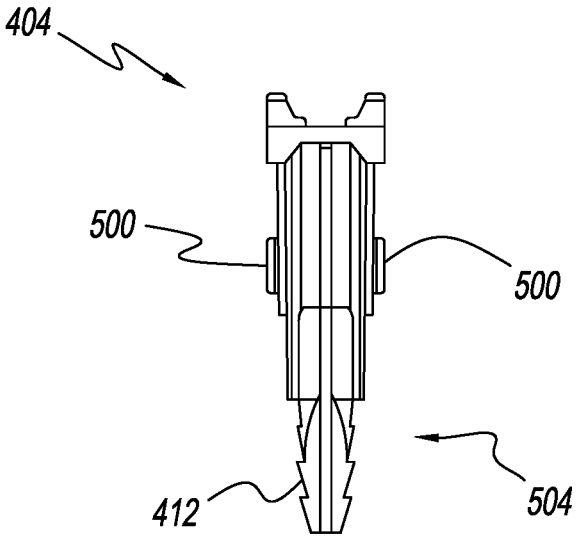
FIG. 5B depicts a top view of the flexible tongue depicted in FIG. 5A, in accordance with embodiments described herein.
Figure 5C:
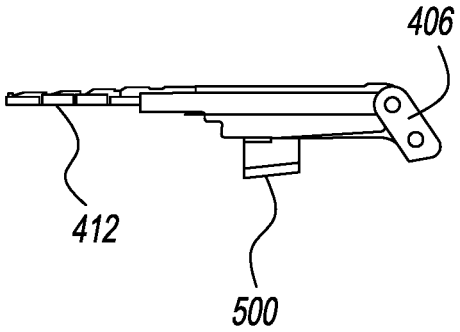
FIG. 5C depicts a side view of the flexible tongue in FIGS. 5A and 5B, in accordance with embodiments described herein.
Figure 5D:
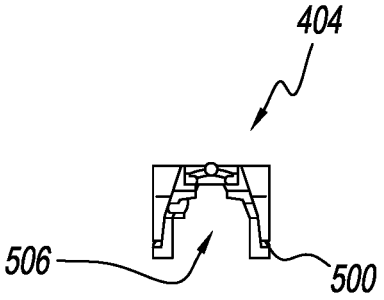
FIG. 5D depicts a rear view of the flexible tongue depicted in FIGS. 5A; 5B; and 5C, in accordance with embodiments described herein

The flexibility of the flexible tongue 404 is dependent upon multiple factors that include but are not limited to the material composition of the flexible tongue 404, the width of the flexible tongue and/or thickness of the flexible tongue 404. In addition, the flexible tongue 404 does not have to be made of the same material as the FIG. 5B depicts a top view of the flexible tongue depicted in FIG. 5A, in accordance with embodiments described herein. FIG. 5C depicts a side view of the flexible tongue in FIG. 5A, in accordance with embodiments described herein. FIG. 5D depicts a rear view of the flexible tongue depicted in FIGS. 5A and 5B, in accordance with embodiments described herein. FIG. 5D also shows a cavity 506 formed by the underside of the flexible tongue 404. A top portion of a handgun is in contact with the underside of the flexible tongue 404.

After a handgun is inserted into the holster sleeve 400, a user may further secure the handgun into the holster sleeve 400 by utilizing the optional elastomeric strap 428. To extract the handgun, a user places a thumb onto the thumb break 416 (or alternatively the release 406) and applies pressure to move the thumb break 416 away from the holster sleeve 400. The flexible tongue 404 flexes where there is no tongue slot 436 to hold the flexible tongue 404 in place. As the flexible tongue 404 rotates away from the holster sleeve 400, the slide catches 500 move away from the handgun slide. When the slide catches 500 are away from the handgun slide the handgun may be extracted from the holster sleeve 400.

The flexible tongue 404 does not have to made of the same material as the left holster sleeve side 402 or the right holster sleeve side 403. In addition, the left holster sleeve side 402 does not have to made of the same material as the right holster sleeve side 403.

Figure 6A:
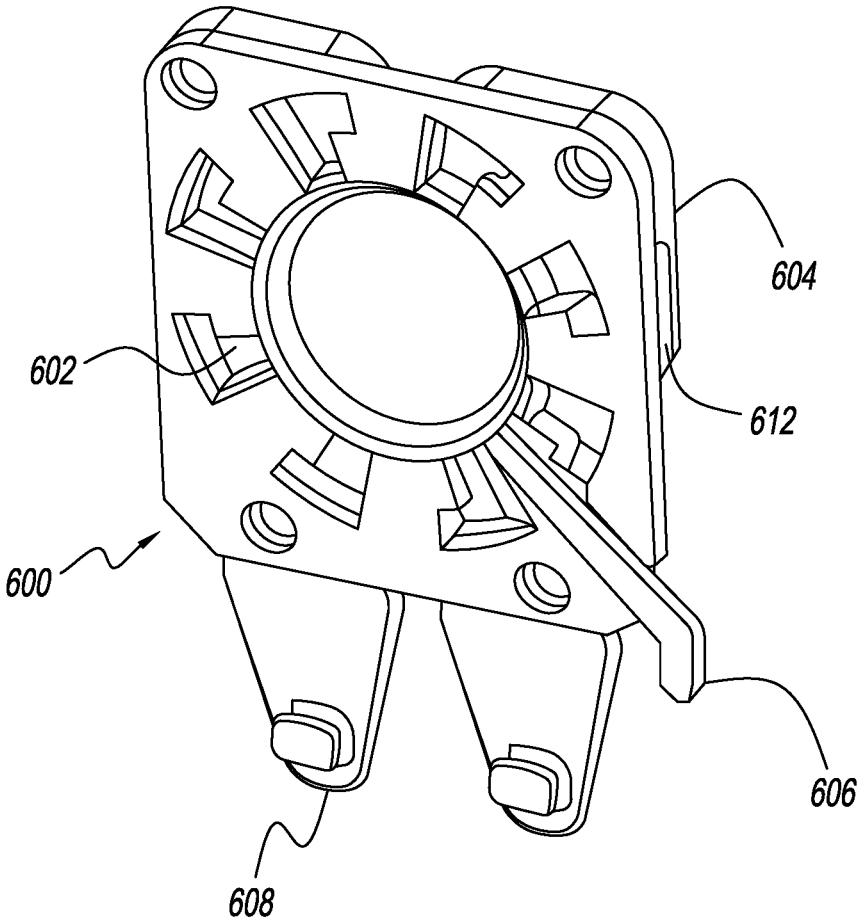
FIG. 6A depicts a perspective view of another lock mount, in accordance with embodiments described herein.
Figure 6B:
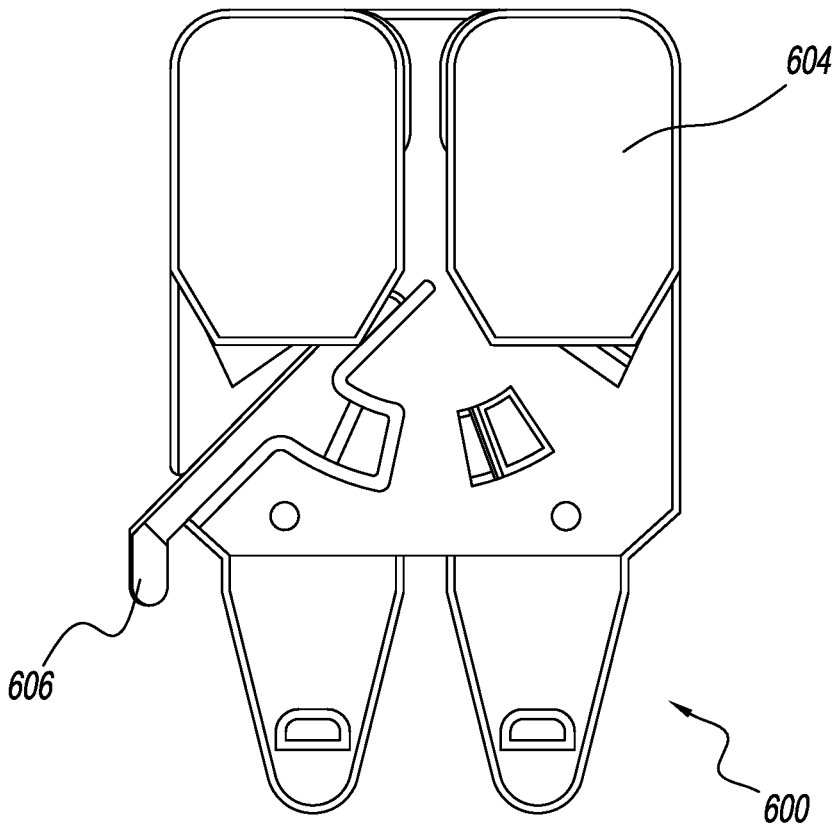
FIG. 6B depicts another perspective view of the lock mount depicted in FIG. 6A, in accordance with embodiments described herein.

FIGS. 6A and 6B depict perspective views of another lock mount 600, in accordance with embodiments described herein. The lock mount 600 includes a male interlocking ring 610, female interlocking plate 602, and a rear mounting plate 604. Various components such as the male interlocking ring 610, the rear mounting plate 604, strap hooks 608, and strap hooks 612 operate the same as similarly named components described above and depicted in FIGS. 1A and 1B. For brevity, those components are not described again. However, female interlocking plate 602 includes a release lever 606 that is in the shape like that of a hockey stick and is actuated using a motion similar to that described with respect to the release lever 114 that is depicted in FIGS. 1A and 1B.

Figure 6C:
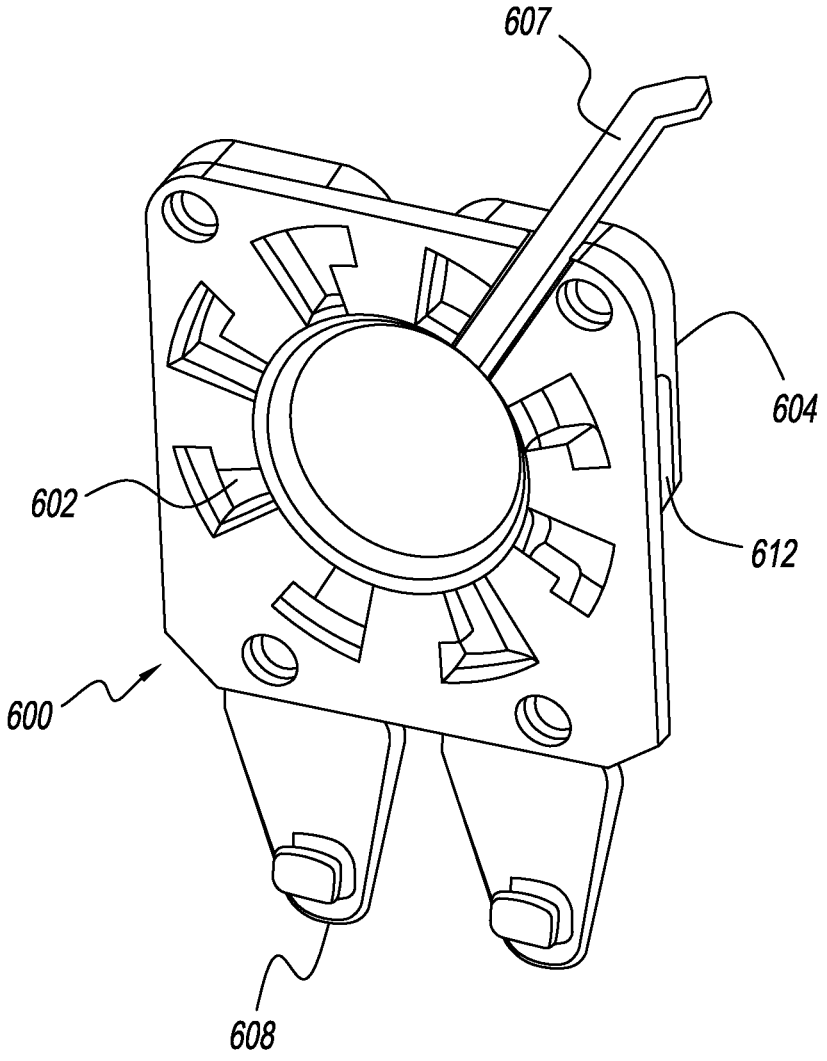
FIG. 6C depicts a perspective view of yet another lock mount, in accordance with embodiments described herein.
Figure 6D:
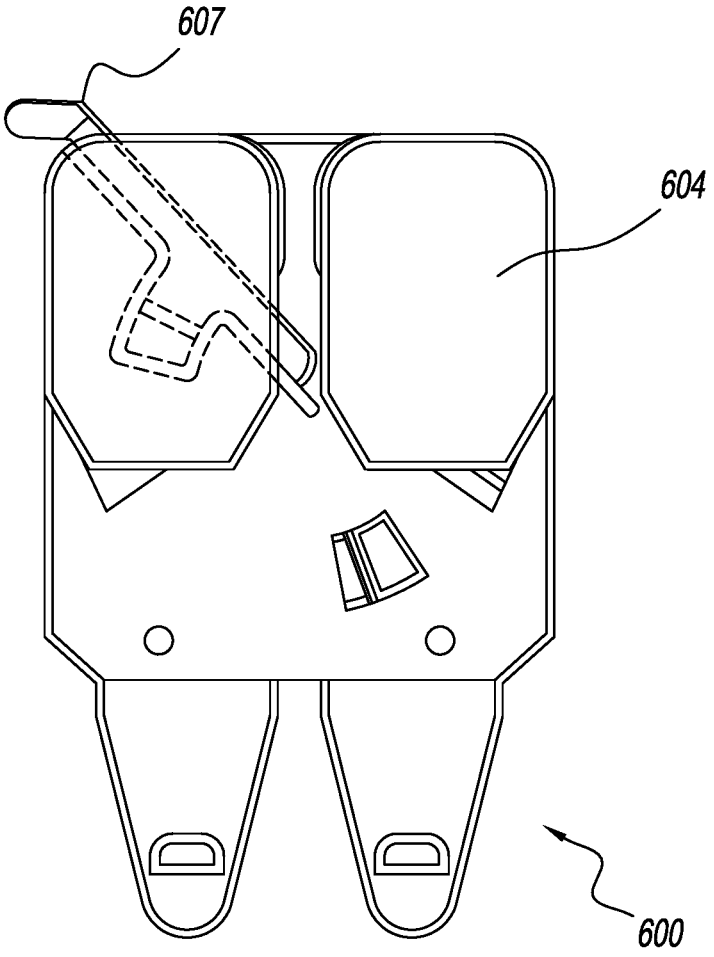
FIG. 6D depicts another perspective view of the embodiment depicted in FIG. 6A, in accordance with embodiments described herein.
Figure 6E:
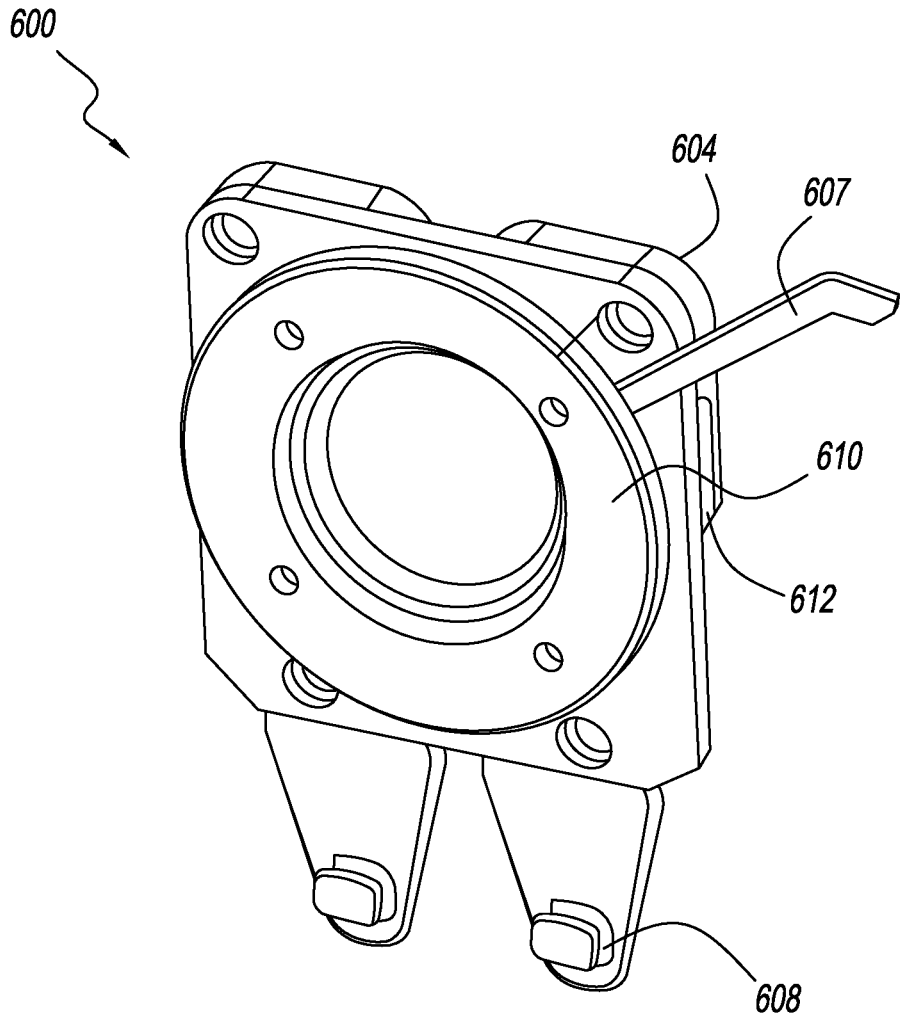
FIG. 6E depicts yet another perspective view of the embodiment depicted in FIG. 6A, in accordance with embodiments described herein.

FIGS. 6C, 6D and 6E depict a perspective view of yet another lock mount 600 where a release lever 607 is positioned differently with respect to the lock mount 600 than the release lever 606 in FIGS. 6A and 6B. The release lever 607 is depicted in the shape like that of a hockey stick and is actuated using a motion similar to that described with respect to the release lever 114 that is depicted in FIGS. 1A, 1B, 6A, and 6B.

Figure 7A:
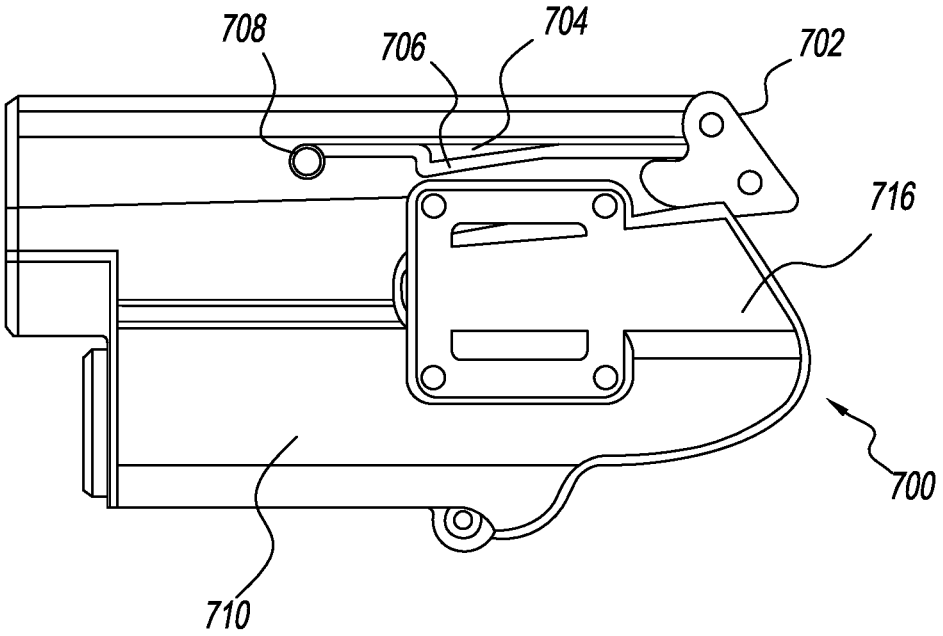
FIG. 7A depicts a perspective view of a unitary holster sleeve, in accordance with embodiments described herein.
Figure 7B:
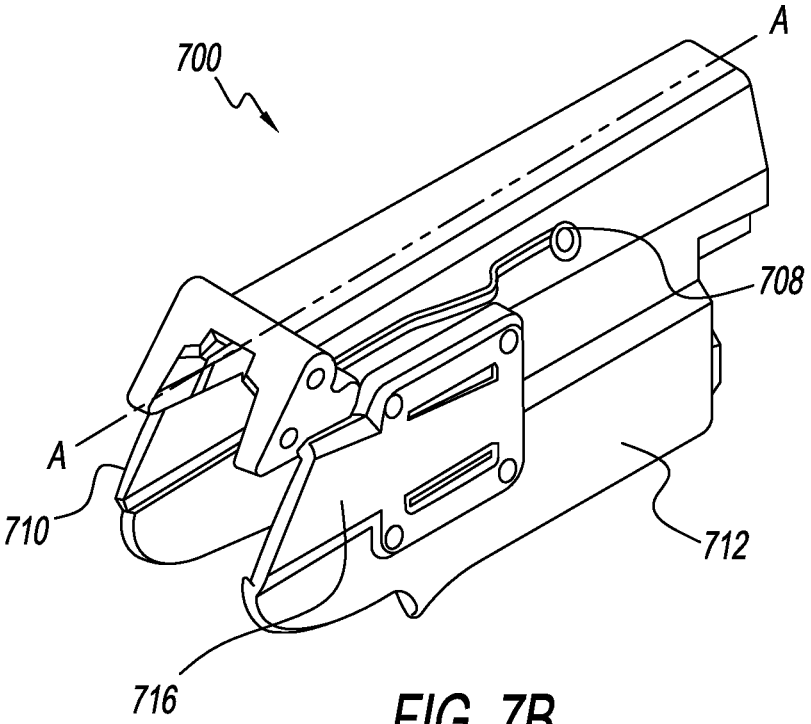
FIG. 7B depicts another perspective view of the unitary holster sleeve depicted in FIG. 7A, in accordance with embodiments described herein.

FIG. 7A depicts a perspective view of a unitary holster 700, in accordance with embodiments described herein. FIG. 7B depicts another perspective view of the unitary holster 700 depicted in FIG. 7A, in accordance with embodiments described herein. The unitary holster 700 includes a left holster sleeve side 710, flexible tongue 702 and right holster sleeve side 712 that are formed together. For example, the left holster sleeve side 710; right holster sleeve side 712; and flexible tongue 702 can be formed together via 3D Printing as a unified body. The flexible tongue 702 includes a slide catch 704 on each side of the flexible tongue 702 that extends partially into an area occupied by a handgun slide (not shown). The right holster sleeve side 712 and the left holster sleeve side 710 each include a notch 704. Also located on the right holster sleeve side 712 and the left holster sleeve side 710 is a rotation bore 708.

Because there is no notch 706 after the rotation bore 708, the flexible tongue 702 acts as a cantilever. The rotation bore 708 acts as a point of rotation for the flexible tongue 702 when a user applies force to the flexible tongue 702 as described above with respect to the movement of the flexible tongue 404. In various embodiments, the unitary holster 700 is ambidextrous similarly to the holster sleeve 400 described above.

Figure 7C:
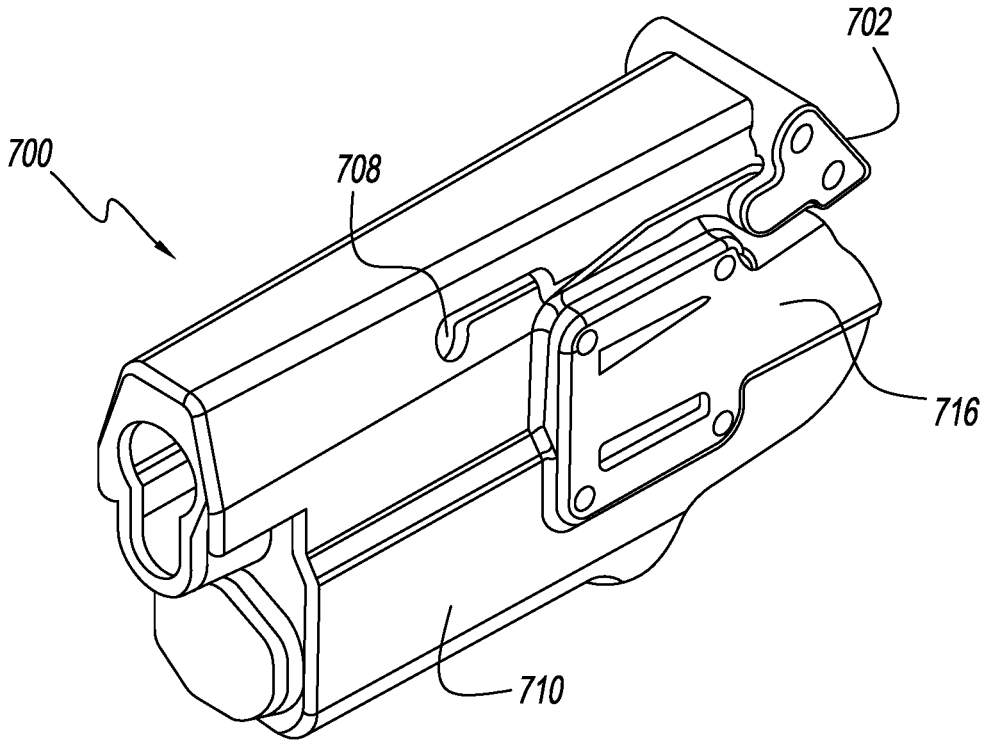
FIG. 7C depicts another perspective view of the unitary holster sleeve depicted in FIGS. 7A and 7B, in accordance with embodiments described herein.

FIG. 7C depicts another perspective view of the unitary holster 700 depicted in FIG. 7A, in accordance with embodiments described herein. In FIG. 7C, the holster sleeve side 712 is visible. In addition, another mounting plate 716 is also present on the left holster sleeve side 712.

Figure 7D:
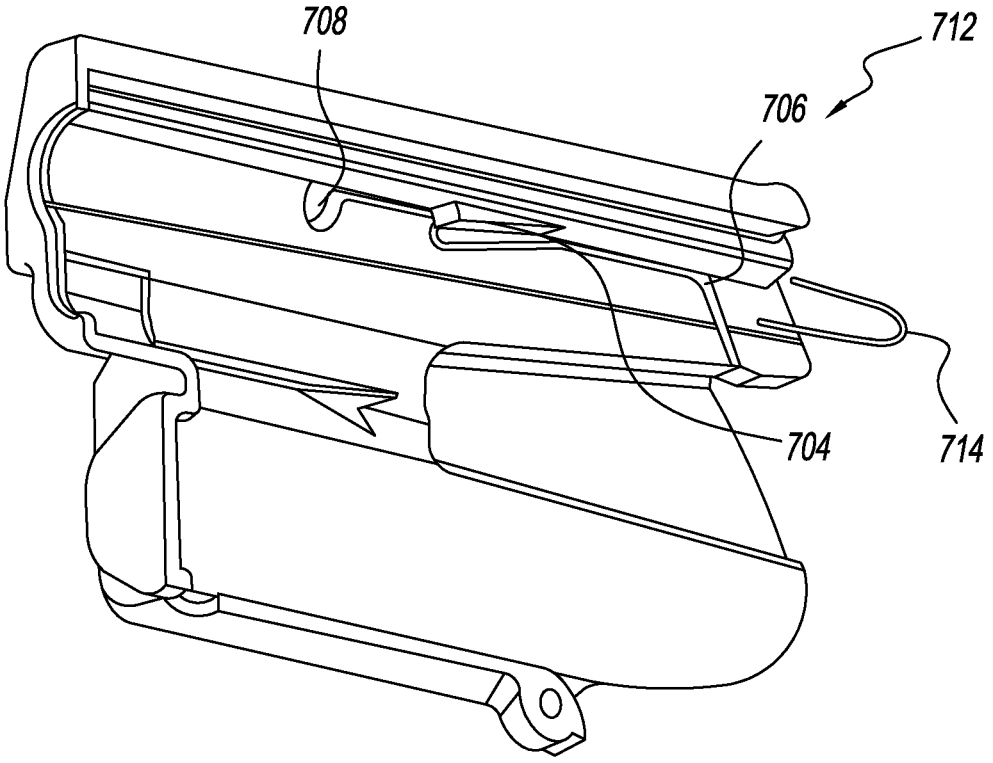
FIG. 7D depicts a cross-sectional view of the unitary holster sleeve along the A-A line depicted in FIG. 7B.

FIG. 7D depicts a cross-sectional view of the unitary holster sleeve 700 along the A-A line depicted in FIG. 7B. In this cross-sectional view, an elastomeric strap 714 is present. The elastomeric strap 714 is used to further secure a handgun within the holster sleeve 700. The elastomeric strap 714 operates similarly to the elastomeric band 428 described above.

Figure 8A:
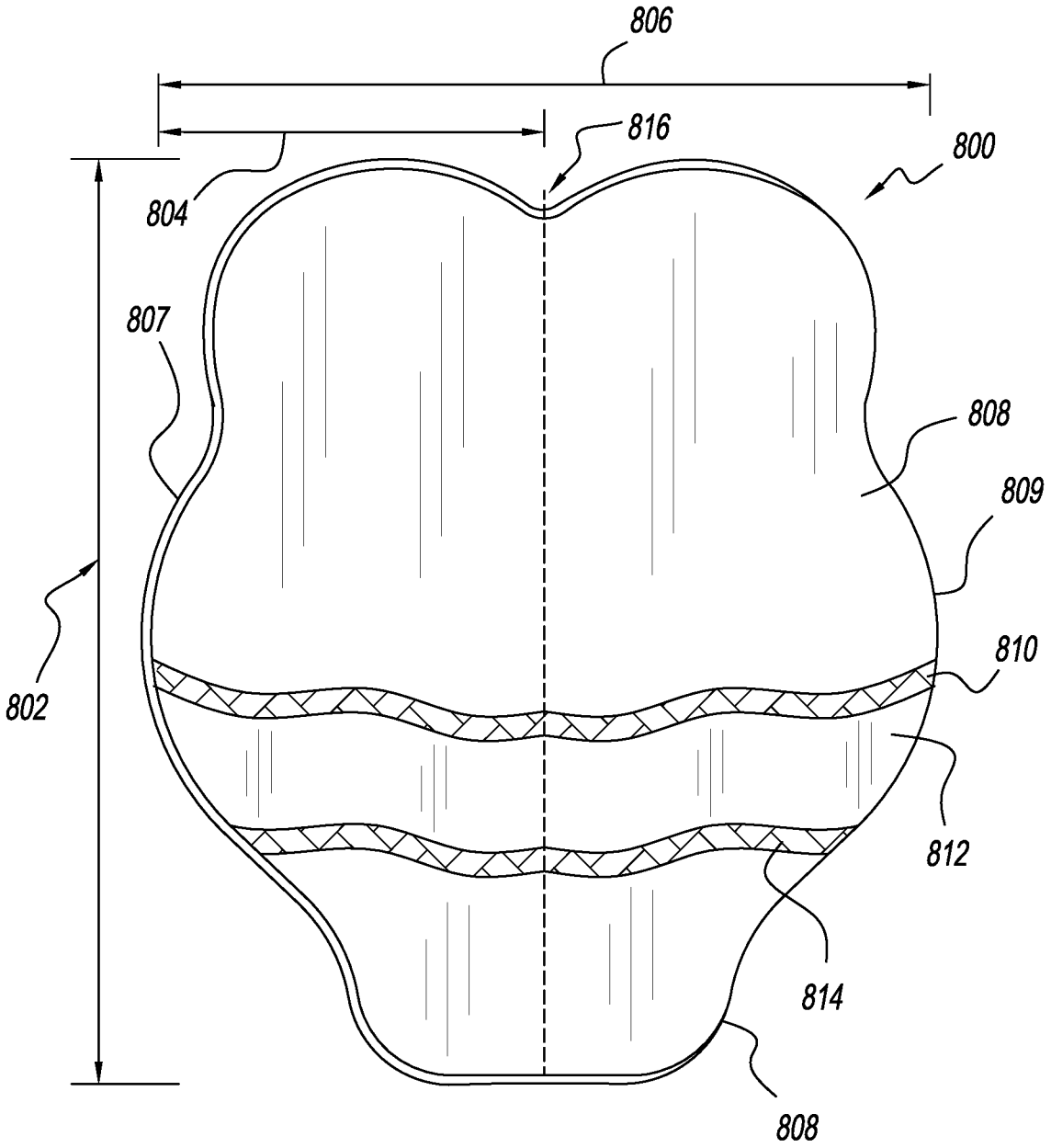
FIG. 8A depicts a layered item holder pattern, in accordance with embodiments described herein.

FIG. 8A depicts a layered item holder pattern 800, in accordance with embodiments described herein. The item holder pattern 800 includes at least one layer of material. Illustratively, the at least one layer is at least one layer of contiguous material that may be folded so that the ends may be secured to form a receptacle for an item. As an example, the at least one layer is depicted, in FIG. 8A, as two outer layers 808 having at least one inner layer 812 between the two outer layers 808. Either (or both) of the two outer layers 808 and/or the at least one inner layer 812 may be made of nylon, polyester, "CORDURA" fabric (a registered trademark of Invista headquartered in Wichita, Kansas), foam, leather, cotton, or man-made materials. In addition, the material(s) used for the two outer layers 808 and/or the at least one inner layer 812 may include flame retardant properties and/or water resistant properties. When laid flat, the item holder pattern 800 includes a width 806 and a length 802. The item holder pattern 800 is symmetrical along the dividing line 816. The dividing line 816 is substantially parallel to the length 802 of the item holder pattern 800 and a longitudinal axis of the item holder pattern 800. The item holder pattern 800 includes a first end 807 and a second end 809. To show the at least one inner layer 812 between the two outer layers 808, a portion of one of the outer layers 808 is removed to show a cross-section 810 of the outer layer 808 having a portion removed to expose the at least one inner layer 812 and the other outer layer 808, and a portion of the at least one inner layer 812 is removed to show a cross-section 814 of the remaining at least one inner layer 812

The item holder pattern 800 is folded along the line 816 and is contoured to prevent an item(s) from falling therethrough. The item holder 800 may be made of multiple layers and then folded to form the item holder 801. In other embodiments, the item holder 801 is not folded but made of multiple layers of material that are secured together to form the item holder 801. The item holder 801 may be washed by machine or hand-washed.

Illustratively, the item holder 801 is described herein and depicted in the FIGs. as being adapted to receive a handgun. However, the item holder pattern 800 may be shaped for use with other items. For example, the item holder 801 may be used to hold tools or non-handgun firearms and weapons. After the item holder pattern 800 is folded to form the item holder 801, a portion of the ends 807 and 809 of the item holder pattern 800 are secured.

Figure 8B:
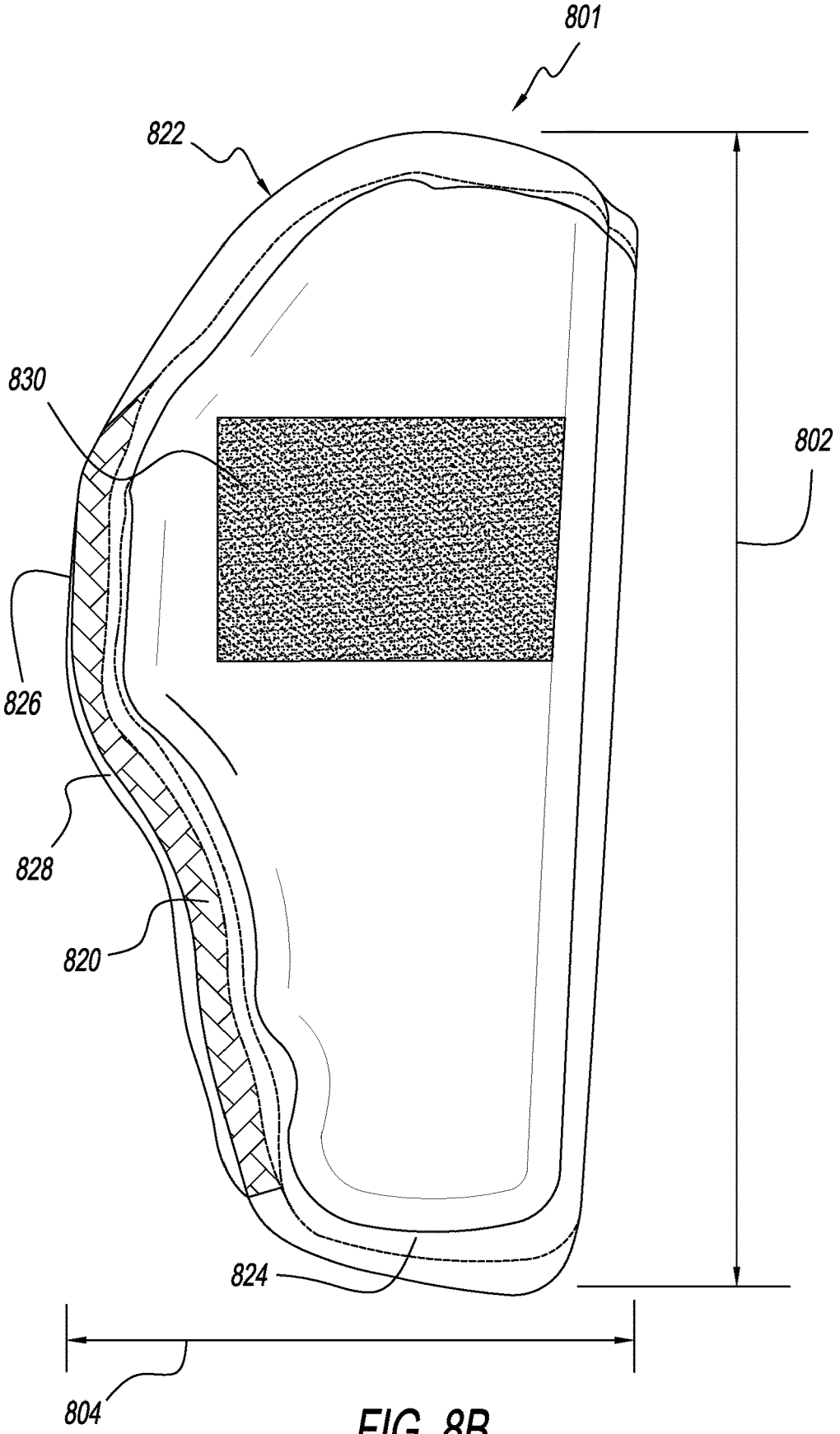
FIG. 8B depicts the layered item holder pattern shown in FIG. 8A folded to form an item holder, in accordance with embodiments described herein.

In FIG. 8B, the portions are secured by stitching 820 to form a cavity (not shown). In other embodiments, portions of the ends 807 and 809 may be secured in other ways (e.g., by use of adhesives or ultra-sonic welding). The contour of the item holder 801 includes a widest portion 826 (when measured along a line that is substantially perpendicular to the length 802 of the item holder 801); and a narrow portion 828 relative to the widest portion 826. The narrow portion 828 helps to position the depth of an item within the item holder 818. For example, the widest portion 826 allows a trigger guard of a handgun (not shown in FIG. 8B) to pass through that portion of the item holder 818. However, the narrow portion 828 prevent the trigger guard from progressing further through the item holder 818.

Because a portion of the ends of the item holder 801 are secured, an opening 822 and an opening 824 are formed. Opening 822 allows reception of an item (not shown) into the cavity of the item holder 801. When the item (e.g., a handgun) is inserted into the cavity of the item holder 801, through the opening 822, a portion of the item may protrude out of the item holder 801 through the opening 824. Opening 824 also allows trash or other unwanted debris to fall out of the item holder 801.

Item holder 801 also includes hook or loop fasteners 830 on both outer sides of the item holder 818. Only one hook or loop fastener 830 is visible in FIG. 8B. The hook or loop fastener 830 corresponds to a hook or loop fastener 836, as described later. For example, when hook or loop fastener 830 is made of hooks then hook or loop fastener 836 is made of loops. Hook and loop fasteners are also known as "VELCRO." VELCRO is a registered trademark of Velcro IP Holdings LLC having a corporate headquarters in Manchester, New Hampshire.

The length of the item holder pattern 802 can vary. For example, in some embodiments, the length of the item holder pattern 802 can be only long enough for placement of the trigger guard or magazine (or other firearm-contained ammunition compartment); and placement of a hook or loop fastener 836 sufficient in strength to support the weight of the item. By way of another example, the length of the item holder pattern 802 may only be long enough to include the widest portion 826 and narrow portion 828 (relative to the widest portion 826); and placement of a hook or loop fastener 836 sufficient in strength to support the weight of the item.

Figure 8C:
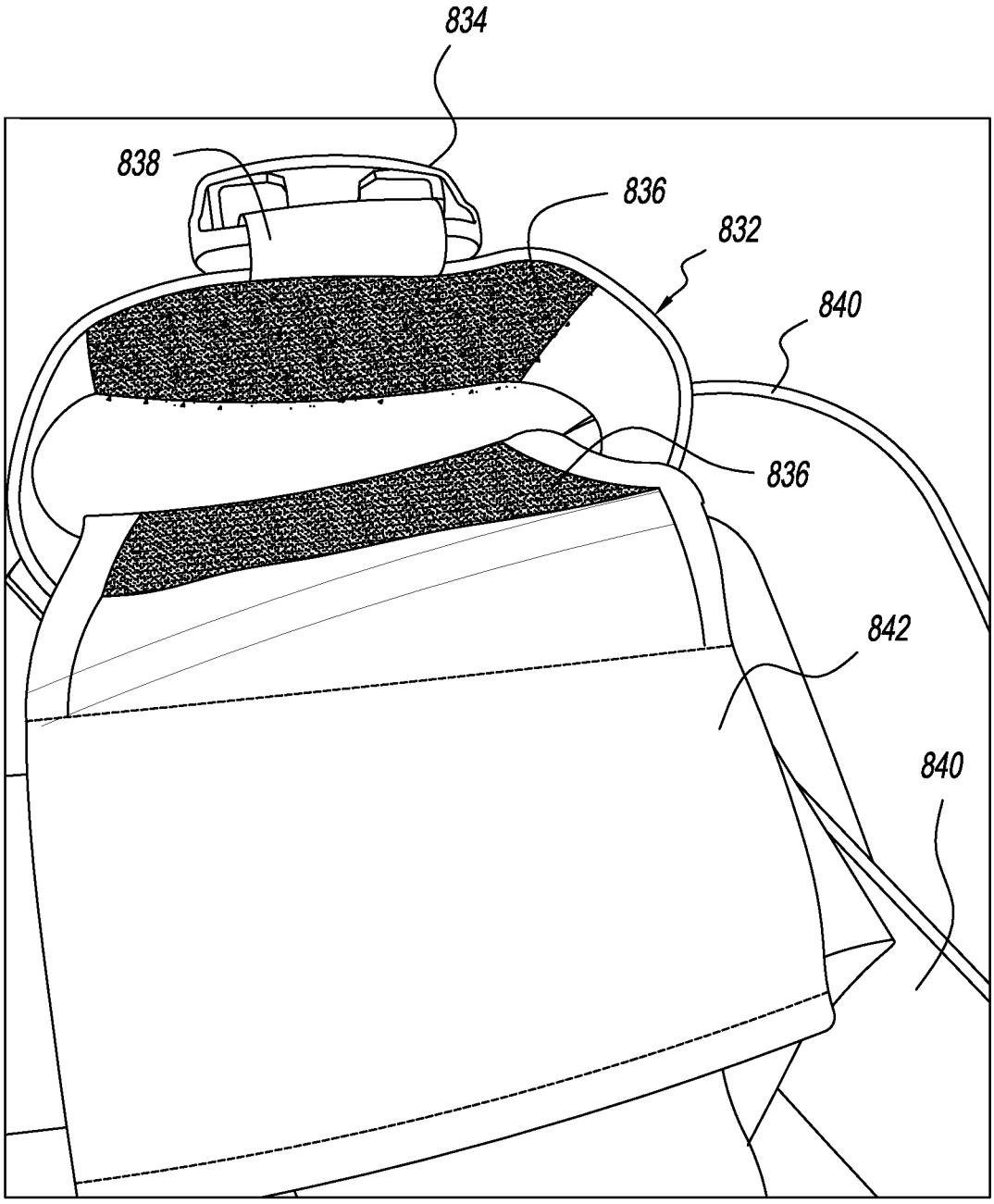
FIG. 8C depicts a perspective view of an item holder mount, in accordance with embodiments described herein.

FIG. 8C depicts a perspective view of an item holder mount 842, in accordance with embodiments described herein. The item holder mount 842 includes horizontal webbing 832 ("horizontal webbing" and "horizontal receiver" are used herein interchangeably) secured to the item holder mount 842. Horizontal webbing 832 is adapted to receive the item holder 801. The horizontal webbing 832 includes an interior surface having hook or loop fasteners 836. When the item holder 801 is inserted into a cavity formed by the horizontal webbing 832, the hook or loop fasteners 830 mate with the hook or loop fasteners 836 to secure the item holder 801 to the inside of the horizontal webbing 832.

Although the horizontal webbing 832 is described herein as "horizontal" that description is only used to describe the relationship of the longitudinal axis of the horizontal webbing 832 to an axis of the item holder 801 when the item holder 801 is inserted into the horizontal webbing 832. For example, the length 802 is parallel to the longitudinal axis of item holder 801 and substantially perpendicular to the longitudinal axis of horizontal webbing 832.

The exterior of the horizontal webbing 832 includes webbing 838 that secures a female portion of a side release buckle 834 to the horizontal webbing 832. Grip straps 840 are also attached to the holster mount 842. Although not shown in FIG. 8C, a male portion of the side release buckle 846 is attached to the end grip straps 840. The male portion of the side release buckle 846 is adapted to mate with the female portion of the side release buckle 834. When a handgun is inserted into item holder 801, the grip straps 840 and mating of the male portion of the side release buckle 846 and female portion of the side release buckle 834 secure the handgun into the item holder 801.

Figure 8D:
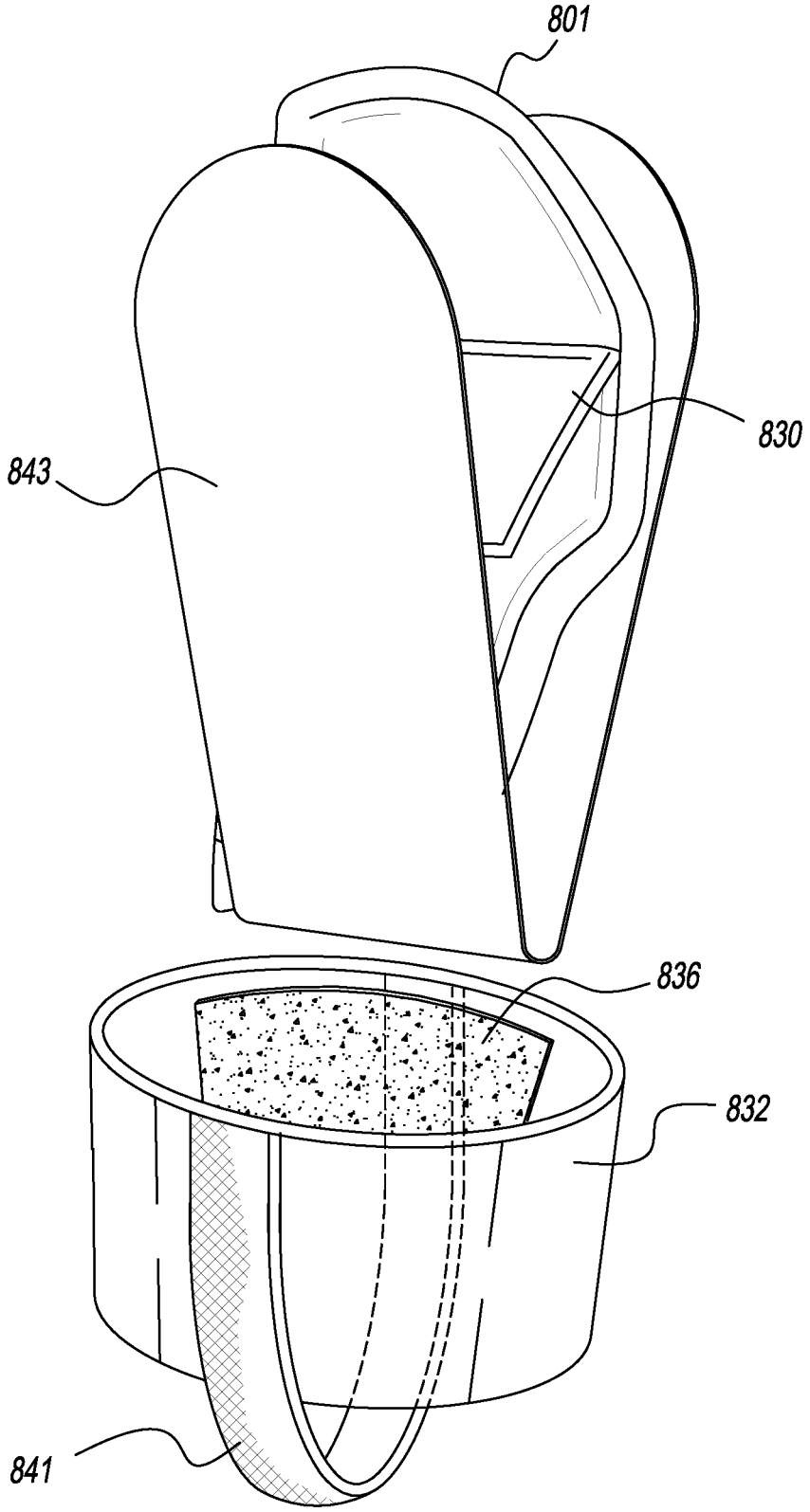
FIG. 8D depicts a perspective view of the item holder shown in FIG. 8B and another embodiment of horizontal webbing, in accordance with embodiments described herein.

FIG. 8D depicts a perspective view of the item holder 801 shown in FIG. 8B and another embodiment of horizontal receiver 832, in accordance with embodiments described herein. In FIG. 8D, the horizontal webbing 832 includes an elastomeric strap 841. The elastomeric strap 841 may be placed over an item (not shown) after the item is inserted into the item holder 801 to secure the item in the item holder 801.

Also depicted in FIG. 8D is the insertion tool 843. The insertion tool 842 may rigid or semi-rigid to allow insertion into the horizontal receiver 832 and extraction from the horizontal receiver 832 when desired. The insertion tool 843, although not required for insertion of the item holder 801 into the horizontal receiver 832, allows for easier insertion of the item holder 801 than without using the insertion tool 843. Illustratively, the insertion tool 843 has a "V" shape however, the insertion tool 843 may be any shape that prevents engagement of hook and loop surfaces and allows insertion within the horizontal receiver 832. In addition, the insertion tool 843 is depicted as a unitary piece however, in various embodiments, the insertion tool 843 may be multiple pieces that when used together function as the insertion tool 843. Portions of the insertion tool 843 cover the hook or loop fasteners 830 on both outer sides of the item holder 801. The item holder 801 is placed inside the insertion tool 843. The insertion tool 843 and item holder 801 are inserted into the horizontal receiver 832. The insertion tool 843 prevents the hook or loop fasteners 830 from interlocking with the hook or loop fasteners 836. When the hook or loop fasteners 830 are aligned with the hook or loop fasteners 836, the insertion tool 843 is extracted from the horizontal receiver 832 leaving the item holder 801 inside the horizontal receiver 832. When the insertion tool 843 is removed, the hook or loop fasteners 836 engage the hook or loop fasteners 830 to secure the item holder 801 inside the horizontal receiver 832. The item holder 801 is ambidextrous (i.e., it can be mounted for use by a left hand or a right hand).

Figure 8E:
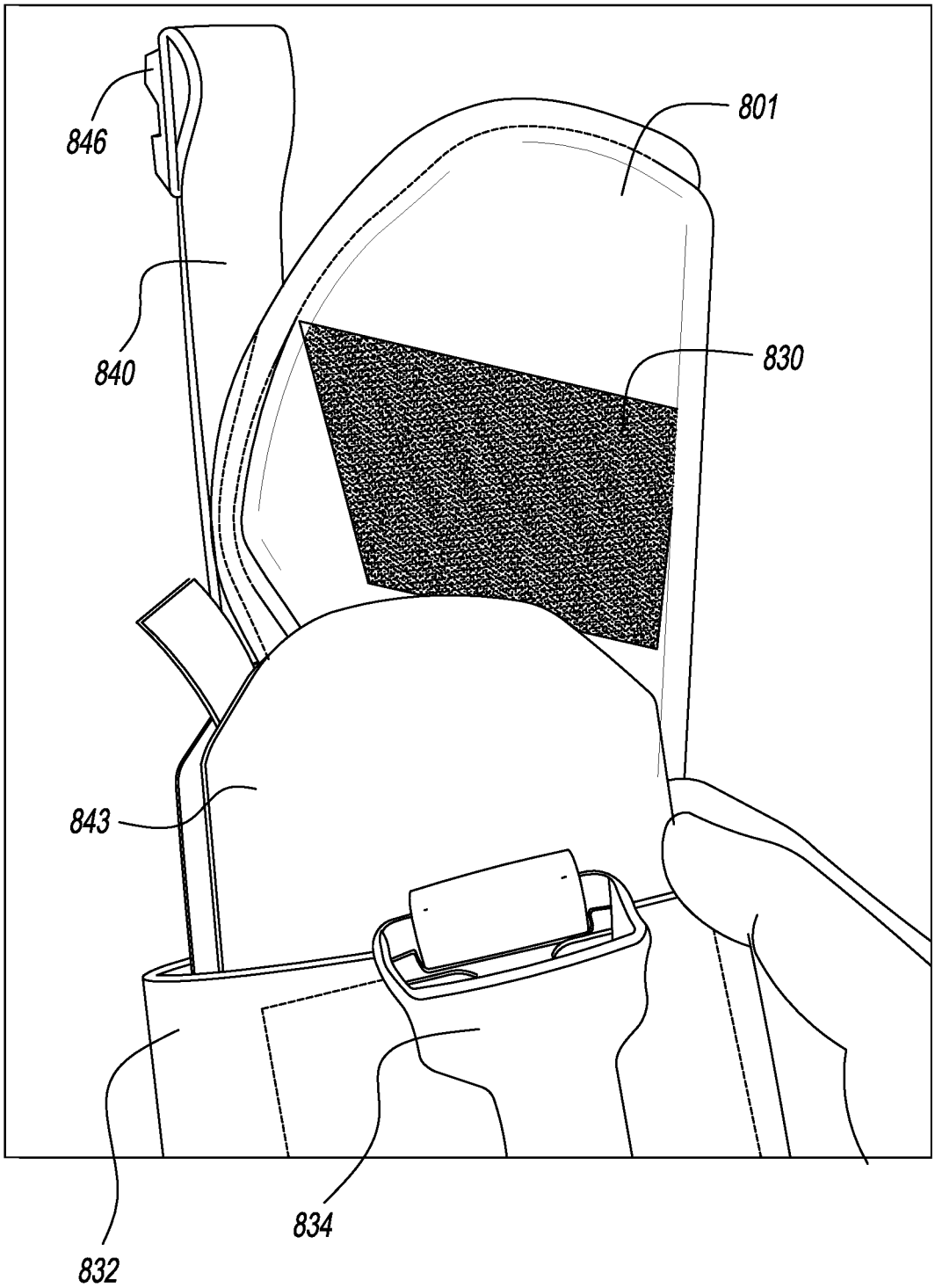
FIG. 8E depicts a perspective view of the item holder shown in FIG. 8B and the item holder mount depicted in FIG. 8C, in accordance with embodiments described herein.

FIG. 8E depicts another perspective view of the item holder 801, the insertion tool 843 and the horizontal receiver 832 shown in FIG. 8C, in accordance with embodiments described herein. FIG. 8E shows that the insertion tool 843 may first be inserted into the horizontal receiver 832 prior to insertion of the item holder 801 into the insertion tool 843. After the item holder 801 is inserted into the insertion tool 843, the insertion tool is extracted from the horizontal receiver 832 to allow mating of the hook or loop fasteners 830 with the hook or loop fasteners 836. FIG. 8E also shows the male portion of the side release buckle 846 at the end of the grip strap 840. When the item holder 801 is inserted within and secured to the horizontal webbing 832, the combination of the item holder 801 and the horizontal webbing 832 form a holster 848 (shown in FIG. 8G).

Figure 8F:
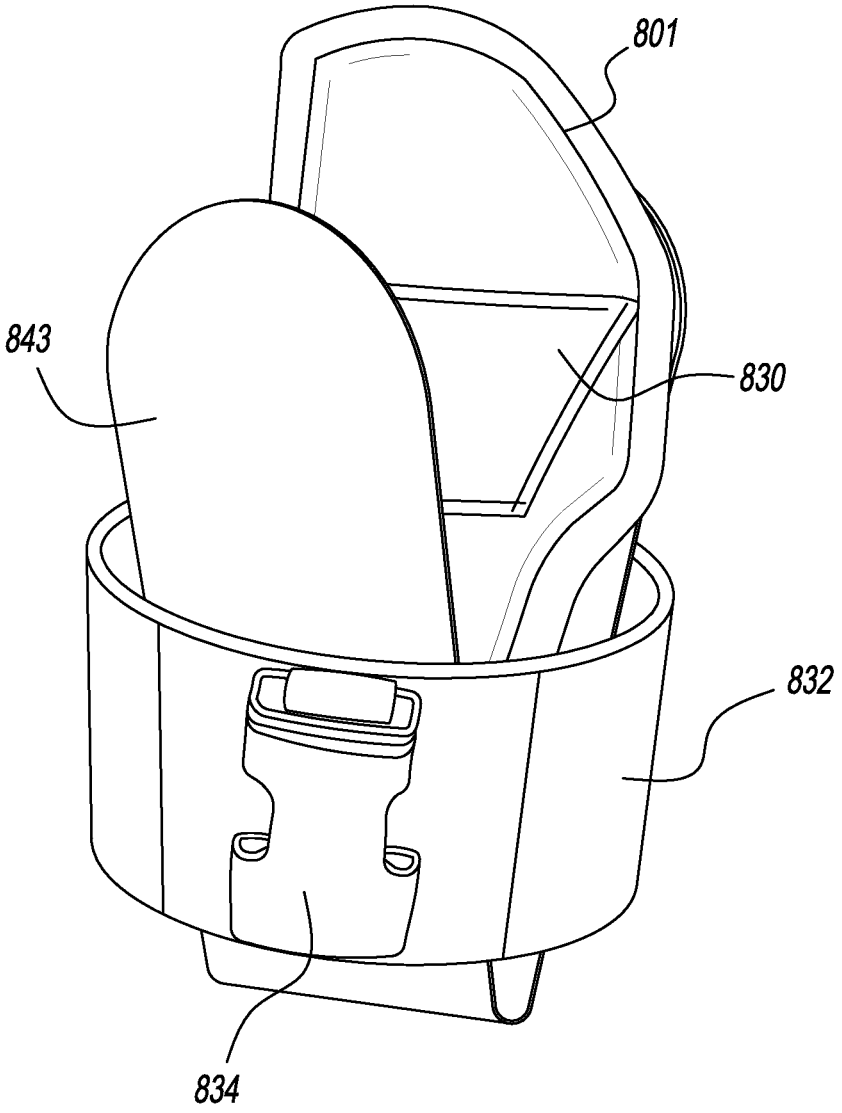
FIG. 8F depicts another perspective view of the item holder shown in FIG. 8B and the horizontal receiver depicted in FIG. 8D, in accordance with embodiments described herein.

FIG. 8F depicts yet another perspective view of the item holder 801, insertion tool 843 and horizontal receiver 832 shown in FIG. 8E, in accordance with embodiments described herein. In FIG. 8F, a bottom portion of the insertion tool 843 extends below the horizontal receiver 832. The bottom portion of the insertion tool 843 may be grasped and pulled from between the item holder 810 and horizontal receiver 832 to extract the insertion tool 843 from the horizontal receiver 832 and allow contact of the hook/loop members 830 to the hook/loop members 836.

Figure 8G:
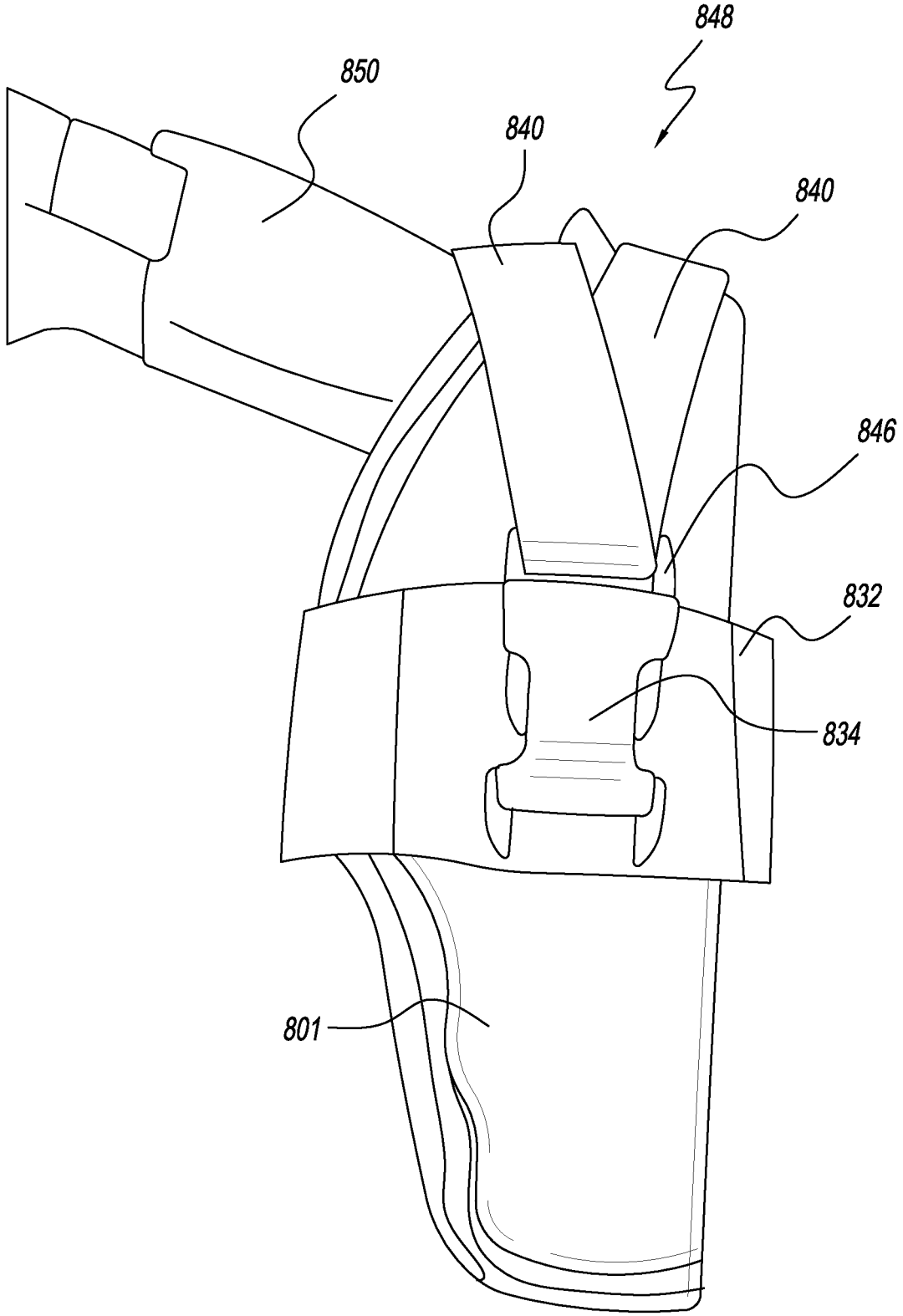
FIG. 8G depicts another perspective view of the item holder and item holder mount depicted in FIG. 8E, in accordance with embodiments described herein.

FIG. 8G depicts a perspective view of the item holder 801, horizontal receiver 832, the grip straps 840, the male portion of the side release buckle 846, and the female portion of the side release buckle 834 to form holster 848. For illustrative purposes only, a handgun 850 is shown inside the holster 848.

FIG. 8G also depicts a handgun 850 inside the holster 848, the grip straps 840 positioned over the handgun 850, and the side release buckle male portion 846 interlocked with the side release buckle female portion 834. With the grip straps 840 positioned over the handgun 850 and the side release buckle male portion 846 interlocked with the side release buckle female portion 834 the handgun 850 is further secured in the holster 848. Although mechanisms such as the elastomeric strap 841, and a combination of the grip straps 840 and side release buckle female portion 834 and side release buckle male portion 846 are described herein they are optional and not required.

Figure 8H:
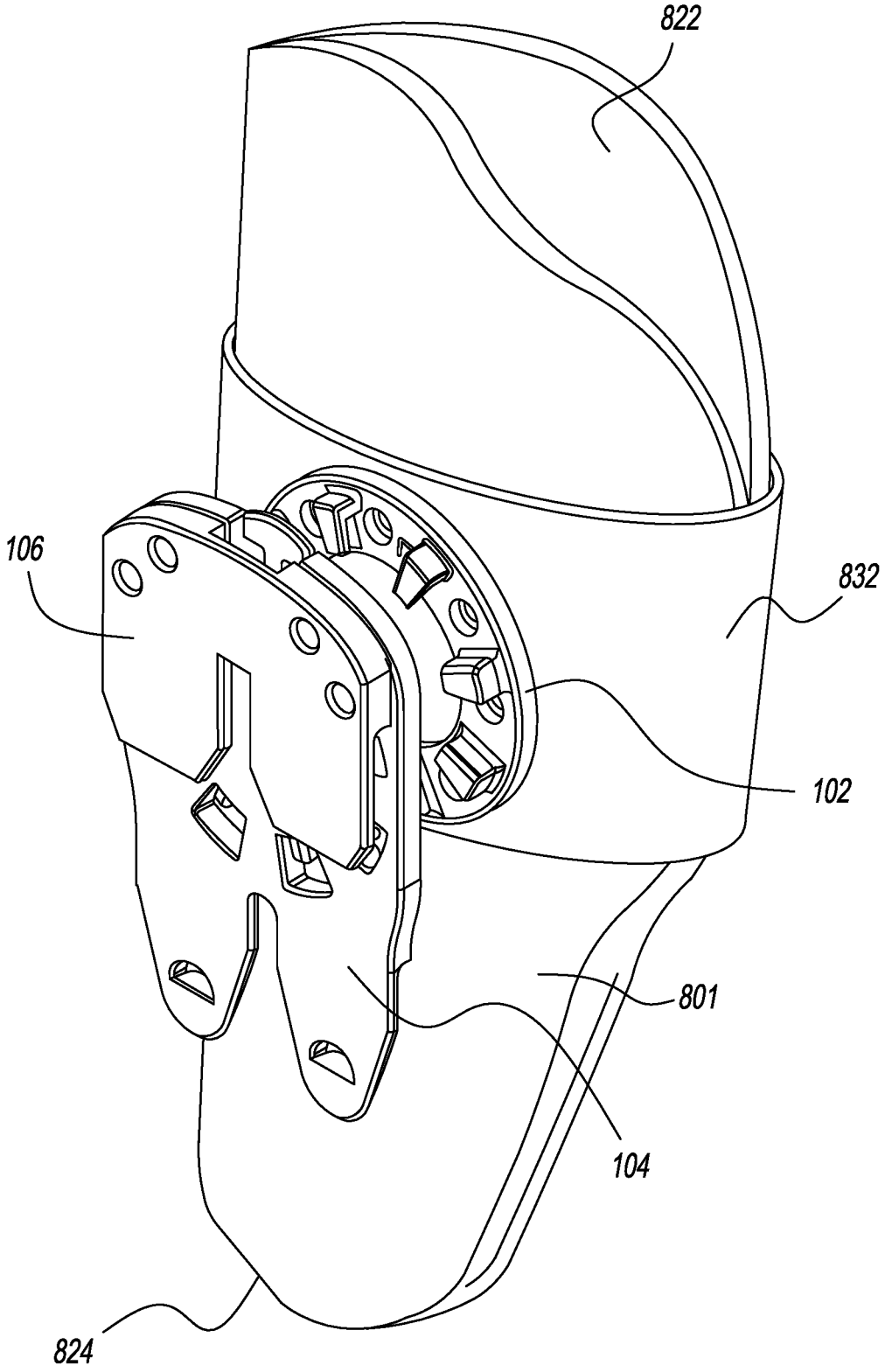
FIG. 8H depicts another perspective view of the item holder having a lock mount, in accordance with embodiments described herein.

FIG. 8H depicts another perspective view of the horizontal receiver 832 having the lock mount 100, in accordance with embodiments described herein. Although FIG. 8H depicts the horizontal receiver 832 coupled to the male interlocking ring 102 that is adapted for interlocking with the female interlocking plate 104. Any of the lock mounts (e.g., lock mounts 100, 200, 300, or 600) described herein may be coupled to the horizontal receiver 832. In addition, the horizontal receiver 832 and item holder 801 may be used to secure an item to other devices (with or without a lock mount). For example, the item holder 801 and horizontal receiver 832 may be used to secure an item to MOLLE webbing, a vehicle, furniture, or a building structure.

Figure 9:
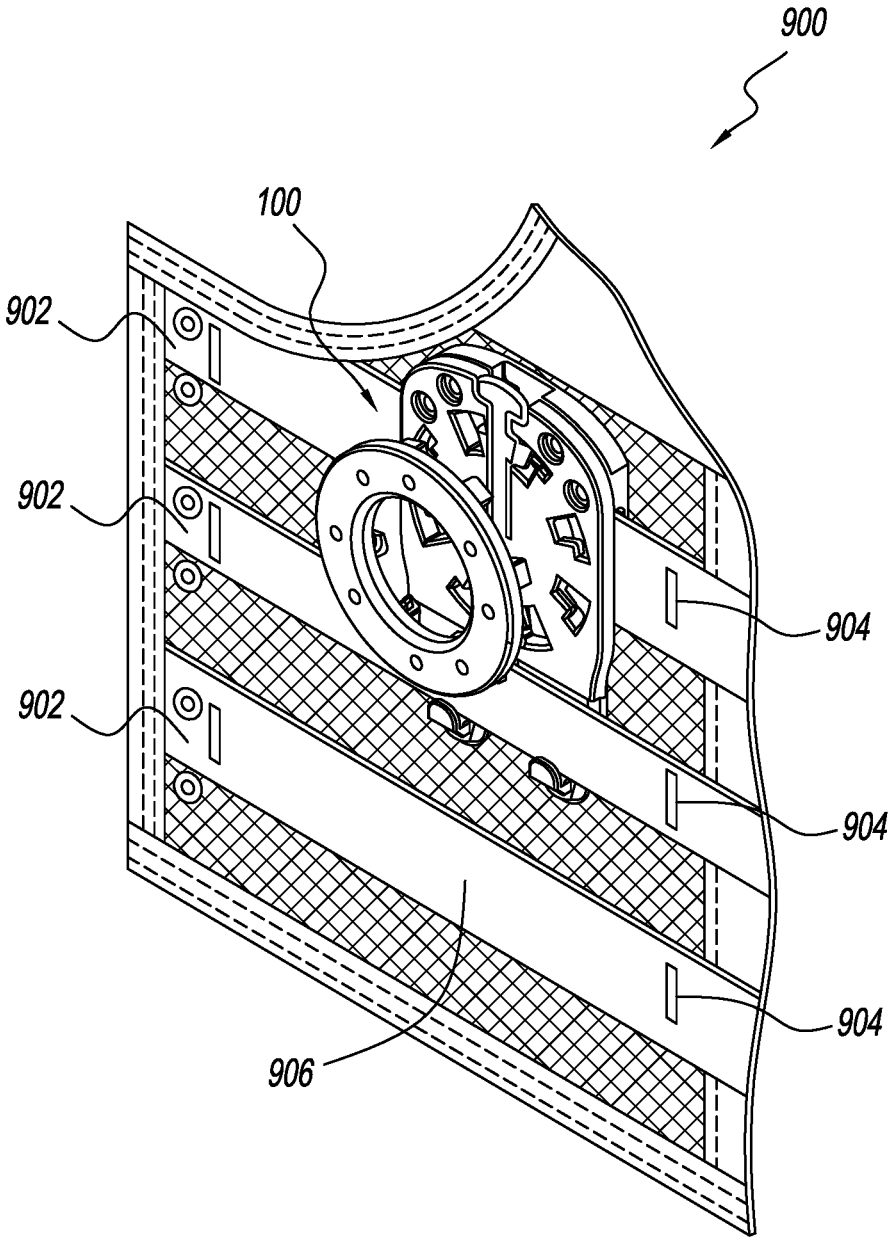
FIG. 9 depicts a lock mount secured to a vest, in accordance with embodiments described herein.

FIG. 9 depicts a lock mount secured to a vest 900, in accordance with embodiments described herein. The vest 900 includes what is also referred to herein as "MOLLE" webbing. MOLLE webbing includes a plurality of substantially horizontal webbing strips 902. The webbing strips 902 are spaced apart from one another. The webbing strips 902 are secured to the vest 900 by substantially vertical stitching 904 relative to the horizontal orientation of the webbing strips 902. Each webbing strip 902 includes multiple sets of stitching 904. Spacing between the webbing strips 902 and the vest 900 that is bounded by the stitching 904 form channels 906. These channels 906 allow items to be secured thereto. One type of item that may be secured to the channels 906 is the adjustable mount 100. The rear mounting plate 106, female interlocking plate 104 and space therebetween form strap hooks 120. A channel 906 is inserted into the strap hooks 120. The at least one strap hooks 118 are placed behind a webbing strip 902 below the webbing strip 902 having strap hooks 120 secured thereto. The at least one strap hook 118 is secured to the lower webbing strip 902.

Figure 10:
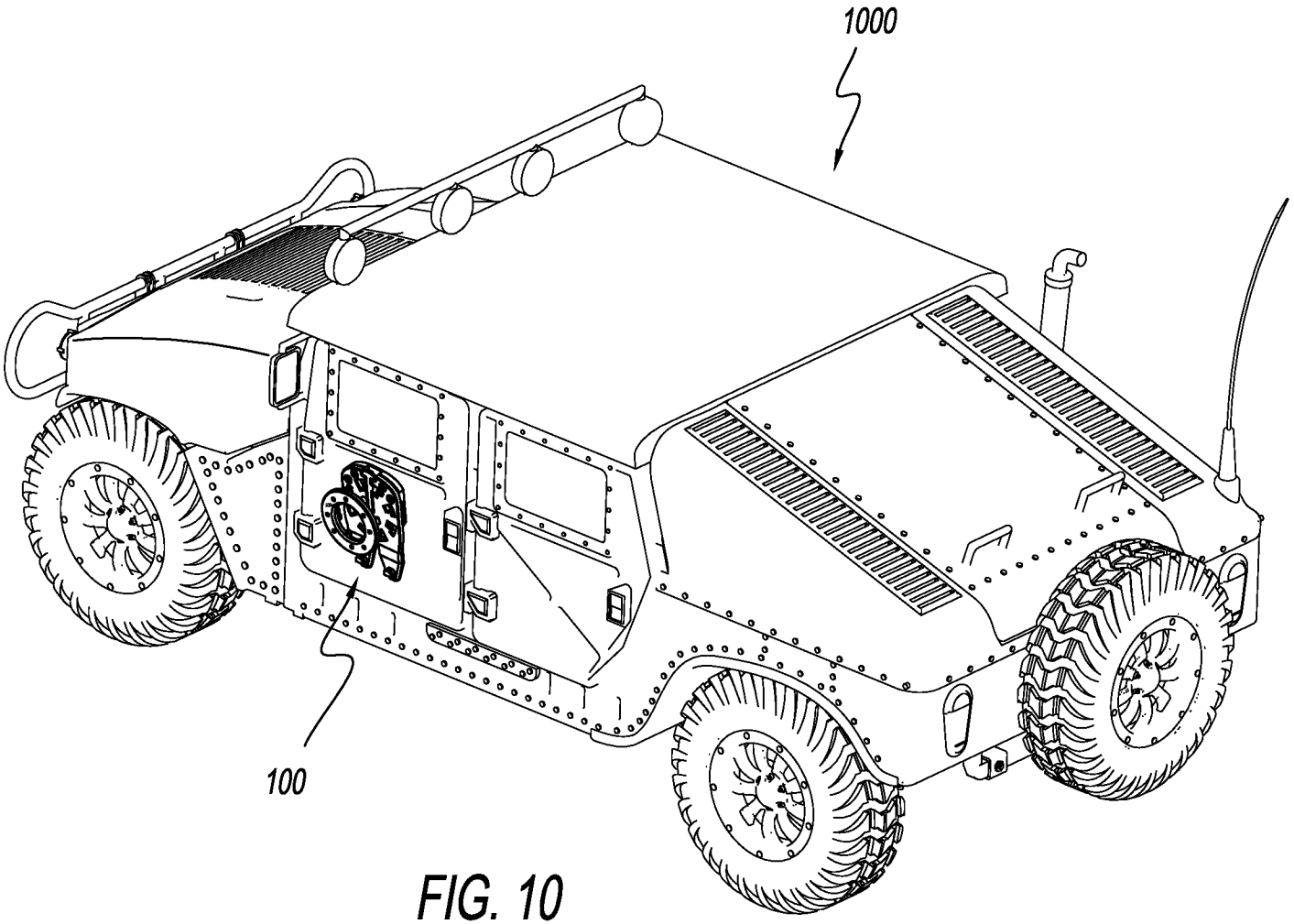
FIG. 10 depicts a lock mount secured to a vehicle, in accordance with embodiments described herein.

FIG. 10 depicts a lock mount secured to a vehicle 1000, in accordance with embodiments described herein. The vehicle 1000 includes an adjustable mount 100 secured thereto.

Figure 11:
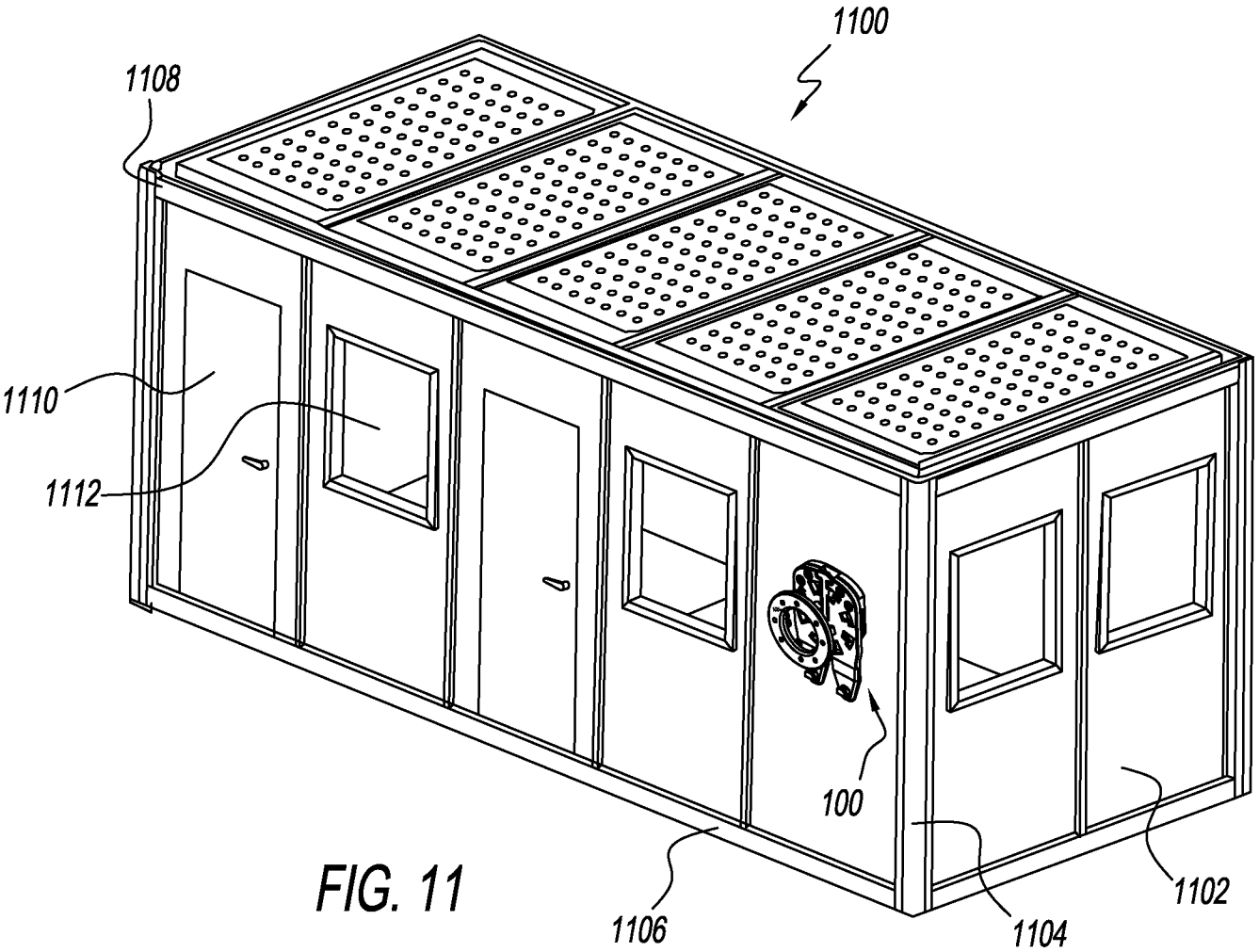
FIG. 11 depicts a lock mount secured to a building, in accordance with embodiments described herein.

FIG. 11 depicts a lock mount secured to a building 1100, in accordance with embodiments described herein. The building 1100 includes walls 1102 and corners 1104 where the walls 1102 meet. A roof 1108 is located above the walls 1102. The walls 1102 and roof 1108 rest on top of a base 1106. The building 1100 also includes a door 1110 and at windows 1112. Located on one of the walls is adjustable mount 100.

Figure 12:
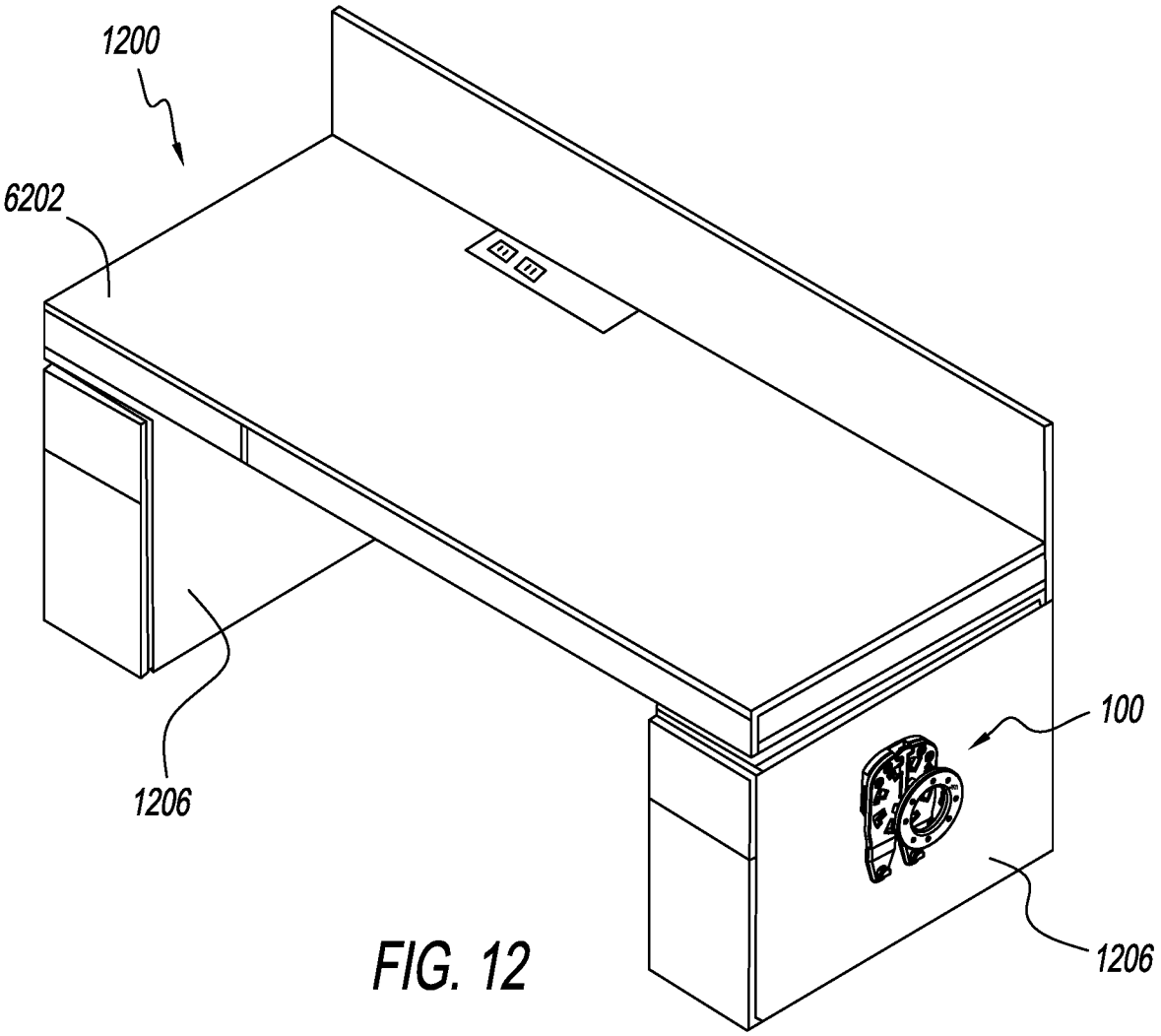
FIG. 12 depicts a lock mount secured to furniture, in accordance with embodiments described herein.

FIG. 12 depicts a lock mount secured to furniture, in accordance with embodiments described herein. For illustrative purposes, the furniture is depicted as a desk 1200. The desk 1200 includes a desk-top 1202 supported by desk-top supports 1204. Secured to the desk 1200 is an adjustable mount 100.

In the foregoing specification, specific embodiments have been described. However, one of ordinary skill in the art appreciates that various modifications and changes can be made without departing from the scope of the teachings disclosed herein as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The claimed material defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A holster comprising:

an item holder comprising, two outer layers of material, wherein each of the two outer layers has a first end and a second end, at least one layer of material between the two outer layers, wherein the at least one layer of material has a first end and a second end that are aligned with the first ends and the second ends of the two outer layers of material, the first end of the two outer layers and the first end of the at least one layer of material are secured to the second end of the two outer layers and the second end of the at least one layer of material to form a receptacle, wherein the receptacle has an interior and an exterior, the interior includes a first opening and a second opening, and a first set of hook/loop fasteners secured to the exterior of the receptacle;

a material loop adapted to receive the item holder, wherein the material loop includes an interior surface and an exterior surface, and the interior surface includes a second set of hook/loop fosters adapted to contact the first set of hook/loop fasteners, wherein the material loop further comprises a first buckle portion secured to the exterior surface and a second buckle portion secured to the exterior surface and adapted to mate with the first buckle portion.

2. The holster of claim 1, wherein the two outer layers are made of a different material than the at least one layer of material.

3. The holster of claim 2, wherein the at least one layer of material is multiple layers of material and where at least two of the layers in the at least one layer of material are made of a different material.

4. The holster of claim 1, wherein the first end of the two outer layers and the first end of the at least one layer of material are secured to the second end of the two outer layers and the second end of the at least one layer of material to form a receptacle.

5. The holster of claim 1 wherein the item holder is adapted to receive a firearm.

6. The holster of claim 1, wherein the material loop includes an elastomeric strap secured to the exterior surface.

7. The holster of claim 6, wherein the elastomeric strap includes a first end and a second end that secures the elastomeric strip to the exterior surface.

8. The holster of claim 1, wherein the holster is secured to a mount.

9. The holster of claim 7, wherein the holster is secured to the mount by an intermediary device, the intermediary device comprising:

a male interlocking ring, wherein the male interlocking ring includes a top surface and an opposing bottom surface, the male interlocking ring includes a plurality of male interlocking members on the top surface of the male interlocking ring; and a unitarily formed female interlocking plate, wherein the unitarily formed female interlocking plate includes a top surface and an opposing bottom surface, the unitarily formed female interlocking plate includes portions on the top surface of the unitarily formed female interlocking plate adapted to receive each of the plurality of male interlocking members, and a flexible release lever wherein the flexible release lever partially extends laterally in one of the portions that are adapted to receive each of the plurality of male interlocking members.

10. The holster of claim 9, wherein each of the plurality of male interlocking members includes a protrusion that includes a portion that extends away from the top surface of the male interlocking ring.

11. The holster of claim 10, wherein each protrusion includes a cavity that is adapted to receive a laterally extending portion of the flexible release lever.

12. The holster of claim 1, wherein the first buckle portion is secured to the exterior surface by a first piece of material and the second buckle portion is secured to the exterior surface by a second piece of material.

13. The holster of claim 1, further comprising a unitary piece of material that is adapted to receive the item holder and be received by the material loop, and prevent mating of the first set of hook/loop fasteners with the second set of hook/loop fasteners.

14. The holster of claim 1, further comprising multiples pieces of material that are adapted to receive the item holder and be received by the material loop, and prevent mating of the first set of hook/loop fasteners with the second set of hook/loop fasteners.

15. A holster comprising:

an item holder comprising, two outer layers of material, wherein each of the two outer layers has a first end and a second end, at least one layer of material between the two outer layers, wherein the at least one layer of material has a first end and a second end that are aligned with the first ends and the second ends of the two outer layers of material, the first end of the two outer layers and the first end of the at least one layer of material are secured to the second end of the two outer layers and the second end of the at least one layer of material to form a receptacle, wherein the receptacle has an interior and an exterior, the interior includes a first opening and a second opening, and a first set of hook/loop fasteners secured to the exterior of the receptacle;

a material loop adapted to receive the item holder, wherein the material loop includes an interior surface and an exterior surface, and the interior surface includes a second set of hook/loop fosters adapted to contact the first set of hook/loop fasteners; and a unitary piece of material that is adapted to receive the item holder and be received by the material loop, and prevent mating of the first set of hook/loop fasteners with the second set of hook/loop fasteners.

16. A holster comprising:

an item holder comprising, two outer layers of material, wherein each of the two outer layers has a first end and a second end, at least one layer of material between the two outer layers, wherein the at least one layer of material has a first end and a second end that are aligned with the first ends and the second ends of the two outer layers of material, the first end of the two outer layers and the first end of the at least one layer of material are secured to the second end of the two outer layers and the second end of the at least one layer of material to form a receptacle, wherein the receptacle has an interior and an exterior, the interior includes a first opening and a second opening, and a first set of hook/loop fasteners secured to the exterior of the receptacle;

a material loop adapted to receive the item holder, wherein the material loop includes an interior surface and an exterior surface, and the interior surface includes a second set of hook/loop fosters adapted to contact the first set of hook/loop fasteners; and multiple pieces of material that are adapted to receive the item holder and be received by the material loop, and prevent mating of the first set of hook/loop fasteners with the second set of hook/loop fasteners.

* * * * *